US010295233B2

(12) United States Patent
Yanase

(10) Patent No.: US 10,295,233 B2
(45) Date of Patent: May 21, 2019

(54) CLOSED COMPRESSOR AND REFRIGERATION DEVICE USING THE SAME

(71) Applicant: Panasonic Intellectual Property Management Co., Ltd., Osaka-shi, Osaka (JP)

(72) Inventor: Seigo Yanase, Shiga (JP)

(73) Assignee: PANASONIC APPLIANCES REFRIGERATION DEVICES SINGAPORE, Singapore (SG)

( * ) Notice: Subject to any disclaimer, the term of this patent is extended or adjusted under 35 U.S.C. 154(b) by 0 days.

(21) Appl. No.: 15/503,324

(22) PCT Filed: Aug. 4, 2016

(86) PCT No.: PCT/JP2016/003603
§ 371 (c)(1),
(2) Date: Feb. 10, 2017

(87) PCT Pub. No.: WO2017/110011
PCT Pub. Date: Jun. 29, 2017

(65) Prior Publication Data

US 2018/0106512 A1 Apr. 19, 2018

(30) Foreign Application Priority Data

Dec. 25, 2015 (JP) ..... 2015-253866

(51) Int. Cl.
*F25B 31/02* (2006.01)
*F04B 39/02* (2006.01)
(Continued)

(52) U.S. Cl.
CPC ..... *F25B 31/023* (2013.01); *F04B 39/0055* (2013.01); *F04B 39/0253* (2013.01);
(Continued)

(58) Field of Classification Search
CPC ..... F04B 39/122; F04B 39/0253; F04B 39/0055; F04B 39/02; F04B 39/12;
(Continued)

(56) References Cited

U.S. PATENT DOCUMENTS 6,607,369 B1 8/2003 Yanase et al.
2007/0092390 A1* 4/2007 Ignatiev ..... F04C 18/0215 418/55.5

(Continued)

FOREIGN PATENT DOCUMENTS

JP 48-000610 U 1/1973
JP 48-035607 U 4/1973

(Continued)

OTHER PUBLICATIONS

Translation of JP 2013-44276 to Haraki.*

*Primary Examiner* — Christopher R Zerphey
(74) *Attorney, Agent, or Firm* — Hamre, Schumann, Mueller & Larson, P.C.

(57) ABSTRACT

A closed compressor is provided with a flexible oil fence, of which a fixed portion as one end is fixed onto an upper surface of a cylinder between a shaft and a cylinder head and a free end as the other end extends toward an upper inner surface of a closed container. According to this configuration, a collision sound can be prevented from being generated even when the oil fence collides with the upper inner surface of the closed container and hot oil can be prevented from flowing along a surface of suction muffler.

9 Claims, 14 Drawing Sheets

(51) Int. Cl.
*F04B 39/12* (2006.01)
*F25B 1/02* (2006.01)
*F04B 39/00* (2006.01)

(52) U.S. Cl.
CPC ..... *F04B 39/122* (2013.01); *F25B 1/02* (2013.01); *F25B 31/02* (2013.01)

(58) Field of Classification Search
CPC .. F04B 39/0284; F04B 39/0292; F04B 53/18; F25B 31/023; F25B 31/002; F25B 1/02; F25B 31/02
USPC ..... 417/415
See application file for complete search history.

(56) References Cited

U.S. PATENT DOCUMENTS

2009/0092504 A1* 4/2009 Akashi ..... F04B 39/0246 417/368
2011/0176942 A1* 7/2011 Yagi ..... F04B 39/023 417/410.1
2011/0243779 A1* 10/2011 Masuda ..... F04C 18/322 418/67
2012/0017634 A1* 1/2012 Dorman ..... F04C 18/16 62/498
2012/0160610 A1* 6/2012 Khoo ..... F04B 39/0253 184/6.21
2014/0140868 A1* 5/2014 Ignatiev ..... F04C 23/008 417/372
2015/0330680 A1* 11/2015 Kinjo ..... F04B 39/0246 62/508

FOREIGN PATENT DOCUMENTS

JP 50-043762 U 12/1975
JP 51-001813 U 1/1976
JP 2000-356188 12/2000
JP 2013-44276 * 3/2013 ..... F04B 39/02

* cited by examiner

PRIOR ART

PRIOR ART

CLOSED COMPRESSOR AND REFRIGERATION DEVICE USING THE SAME

TECHNICAL FIELD

The present invention relates to a closed compressor and a refrigeration device using the same such as an electric refrigerator-freezer for home use and a showcase.

BACKGROUND ART

In the related art, as one of these types of closed compressors, there is a closed compressor in which oil sucked up from a lower end of a crank shaft is ejected from an upper end, falls onto a rib formed on a block, and becomes an oil droplet (for example, refer to PTL 1).

FIG. 13 is a side sectional view of a closed electric compressor in the related art which is described in PTL 1 and FIG. 14 is a sectional view taken along arrow 14-14 in FIG. 13.

As illustrated in FIGS. 13 and 14, the closed electric compressor in the related art includes closed container 1, oil 2 that is reserved in a bottom portion of closed container 1, compression unit 3 that is disposed on an upper side, and electric unit 4 that is disposed on a lower side. Compression unit 3 includes crank shaft 5, of which lower end 6 is immersed in oil 2 and which is rotated by electric unit 4, and block 8 that rotatably supports crank shaft 5. In addition, block 8 is provided with cylinder 9 including an open end and rib 12 for fixing cylinder head 13 that serves as a lid of the open end of cylinder 9 and suction muffler 14 is disposed below rib 12 of block 8.

CITATION LIST

Patent Literature

PTL 1: Japanese Patent Unexamined Publication No. 2000-356188

SUMMARY OF THE INVENTION

However, according to a configuration in the related art, in a case where the overall height of the closed compressor is decreased, a gap between an upper inner surface of closed container 1 and rib 12 becomes narrow, and rib 12 collides with the upper inner surface of closed container 1 due to the vibration of compression unit 3, which occurs when the closed compressor is activated or stopped, thereby generating a collision sound. Therefore, it is necessary to decrease the height of rib 12 to avoid the collision. However, when the height of rib 12 is decreased, hot oil 2 which is scattered from upper end 7 of crank shaft 5 as illustrated by arrows in FIG. 13 flies toward cylinder head 13 side beyond an upper portion of rib 12 and is sprinkled onto suction muffler 14. Then, hot oil 2 flows along a surface of suction muffler 14 so that a refrigerant gas passing through suction muffler 14 is heated and the volumetric efficiency may be decreased. Accordingly, there is a problem that the height of rib 12 cannot be decreased and thus the overall height of closed container 1 cannot be decreased.

The present invention provides a closed compressor that prevents a collision sound in a closed container from being generated even in a case where the overall height of the closed container is decreased and a refrigeration device using the same.

In addition, the present invention provides a closed compressor which achieves high efficiency by preventing hot oil from being sprinkled onto a suction muffler and flowing along a surface of the suction muffler, preventing a refrigerant passing through the suction muffler from being heated, and preventing the volumetric efficiency from being decreased and a refrigeration device using the same.

In the closed compressor of the invention, a flexible oil fence, of which a fixed portion as one end is fixed onto an upper surface of a cylinder between a shaft and a cylinder head and a free end as the other end extends toward an upper inner surface of a closed container, is provided.

Since the oil fence is flexible, a collision sound can be prevented from being generated even in a case where the free end of the oil fence that extends toward the upper inner surface of the closed container collides with the upper inner surface of the closed container due to the vibration of a compression unit which occurs when the closed compressor is activated or stopped. In addition, it is possible to narrow a gap between the upper inner surface of the closed container and the upper surface of the cylinder. Furthermore, it is possible to prevent hot oil from flowing along a surface of a suction muffler with the oil fence holding back (blocking) oil, which is scattered from an upper end portion of an eccentric shaft due to a centrifugal force. Therefore, it is possible to prevent a refrigerant gas passing through the suction muffler from being heated.

DESCRIPTION OF EMBODIMENTS

Hereinafter, embodiments of the invention will be described with reference to the drawings. Note that, the invention is not limited by the embodiments.

First Embodiment

Figure 1:
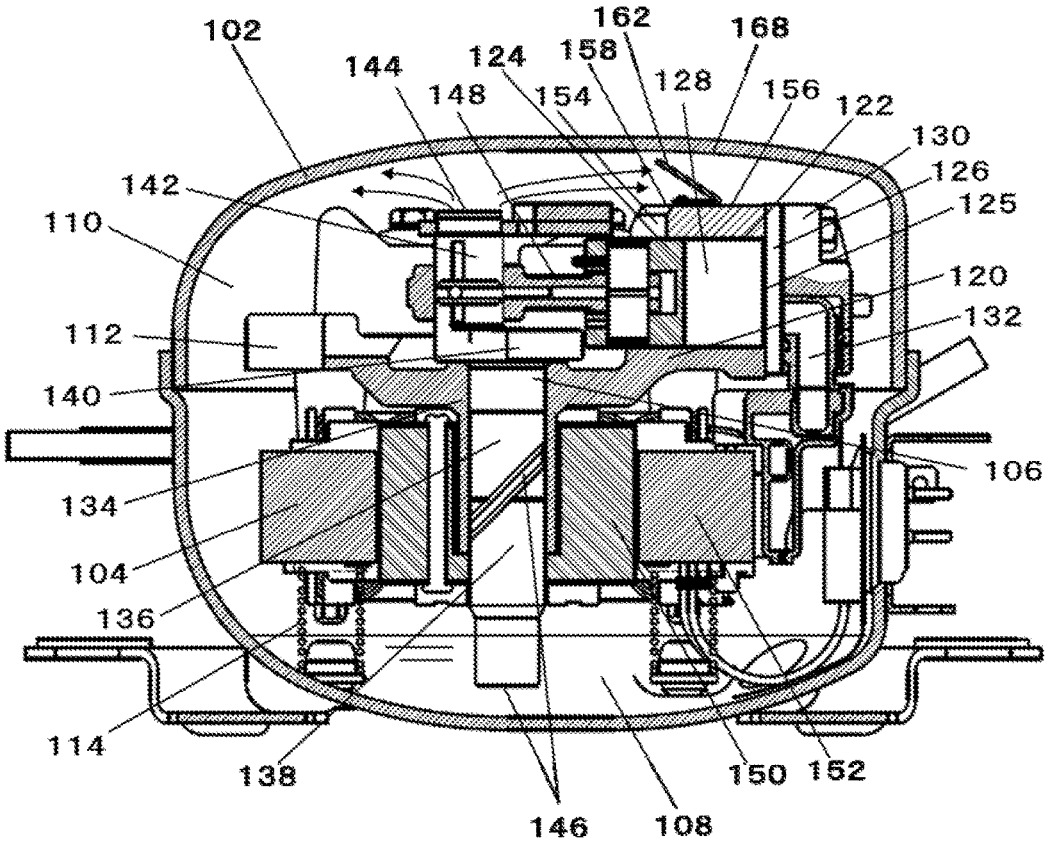
FIG. 1 is a longitudinal sectional view of a closed compressor according to a first embodiment of the invention.
Figure 2:
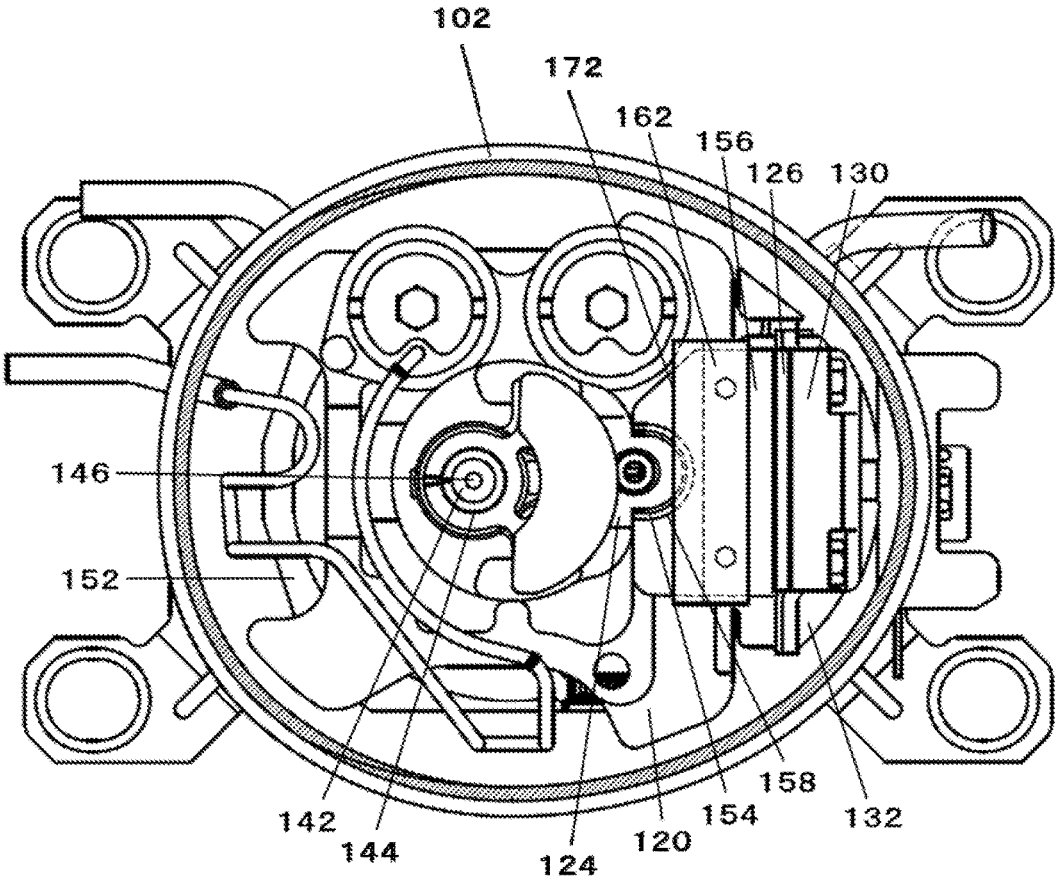
FIG. 2 is a top view obtained by cutting a closed container of the closed compressor according to the first embodiment of the invention in a lateral direction.
Figure 3:
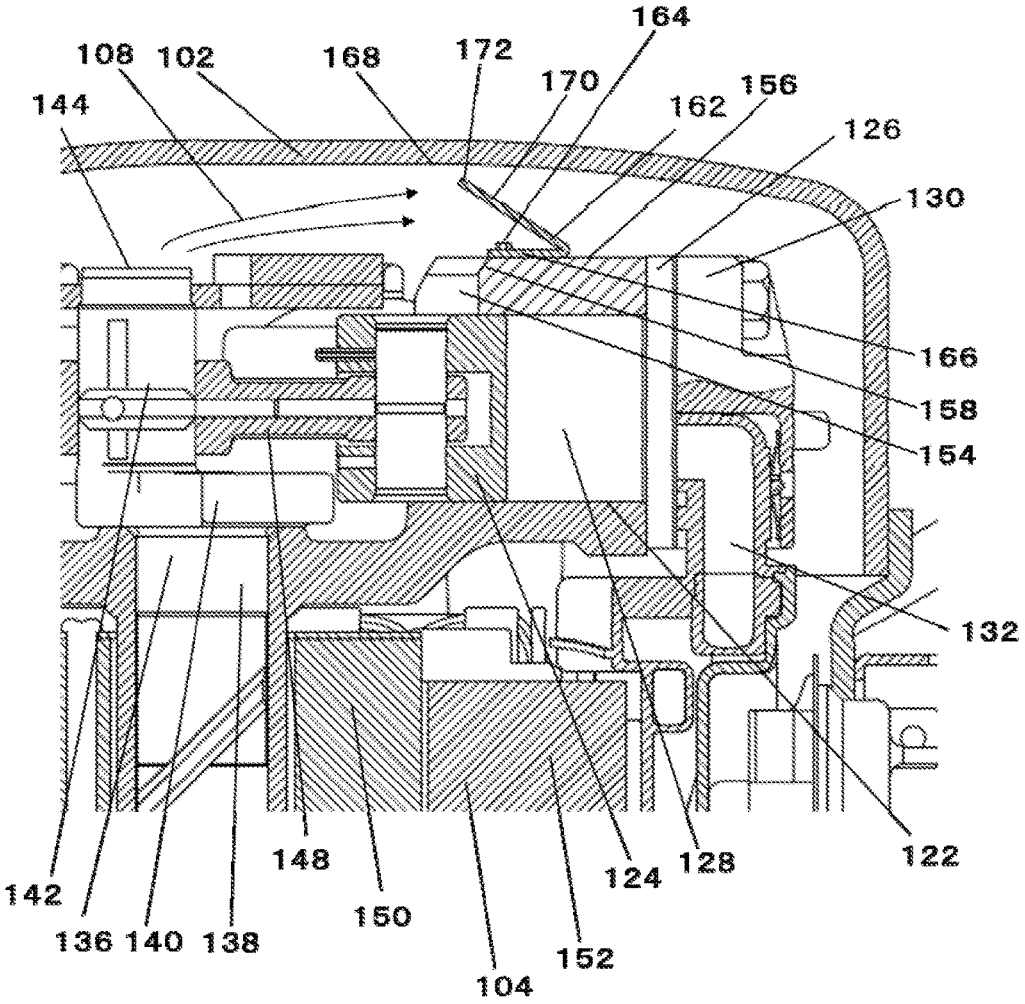
FIG. 3 is a sectional view illustrating a main portion of the closed compressor according to the first embodiment of the invention.

FIG. 1 is a longitudinal sectional view of a closed compressor according to a first embodiment of the invention and FIG. 2 is a top view obtained by cutting a closed container of the closed compressor according to the first embodiment of the invention in a lateral direction. FIG. 3 is a sectional view illustrating a main portion of the closed compressor according to the first embodiment of the invention.

In FIGS. 1 to 3, in the closed compressor according to the first embodiment, electric unit 104 and compression unit 106 which is driven by electric unit 104 are accommodated in closed container 102 which is formed through sheet metal drawing and oil 108 for lubrication is reserved in a bottom portion of closed container 102. Furthermore, closed container 102 is filled with, for example, refrigerant gas 110 such as hydrocarbon based R600a having a low global warming potential at a pressure equal to the pressure at a low pressure side of a refrigeration device (which will be described in FIG. 12) in a relatively low-temperature state.

Electric unit 104 and compression unit 106 are integrally assembled to configure compressor main body 112 and compressor main body 112 is elastically supported on a bottom surface in closed container 102 by at least three coil springs 114.

In cylinder block 120 constituting compression unit 106, hollow cylindrical cylinder 122 is formed and piston 124 is fitted into cylinder 122 such that piston 124 can freely reciprocate in cylinder 122.

Valve plate 126 is attached to open end 125 of cylinder 122 and valve plate 126 defines compression chamber 128 with cylinder 122 and piston 124. Furthermore, cylinder head 130 is fixed such that cylinder head 130 covers valve plate 126 and serves as a lid. Suction muffler 132 is formed of resin such as polybutylene terephthalate (PBT), includes a muffling space formed therein, is disposed below cylinder head 130, and is attached.

Main bearing 134 is formed at a lower portion of cylinder block 120.

Shaft 136 is constituted by main shaft portion 138 that is rotatably supported by main bearing 134 in a vertical direction, flange portion 140, and eccentric shaft portion 142 that is formed with flange portion 140 being interposed between main shaft portion 138 and eccentric shaft portion 142. Shaft 136 includes oil supply passage 146 through which a lower end of main shaft portion 138 communicates with an upper end (upper end portion 144) of eccentric shaft portion 142. Furthermore, the lower end of main shaft portion 138 is immersed in oil 108 reserved in closed container 102 and upper end portion 144 of eccentric shaft portion 142 opens into closed container 102.

Cylinder 122 is disposed being separated from shaft 136 in a lateral direction.

Cylinder head 130 is disposed being further separated from shaft 136 in the lateral direction and is disposed beside cylinder 122.

Eccentric shaft portion 142 and piston 124 are connected to each other through connecting rod 148.

Electric unit 104 is a DC brushless motor that is constituted by rotator 150 which is fixed to main shaft portion 138 in a press-fitting manner or the like and stator 152 which is fastened to a lower portion of cylinder block 120 such that stator 152 surrounds the peripheral portion of rotator 150 while being coaxial with rotator 150.

Slot 154 which is cut out into a semi circular shape, a C-like shape, or an U-like shape as seen from above in the vertical direction is formed on an upper side surface of cylinder 122 on shaft 136 side and chamfer 158 is provided on a corner at which slot 154 and upper surface 156 of cylinder 122 meet.

Piston 124 which reciprocates in cylinder 122 is disposed below slot 154.

Oil fence 162 which is formed by using a flexible resin film made of polyethylene terephthalate (PET) or the like is provided in the vicinity of slot 154 that is present on upper surface 156 of cylinder 122 on shaft 136 side.

Oil fence 162 is formed to include fixed portion 166 as one end and free end 170 as the other end.

Oil fence 162 is formed to include fixed portion 166, which is fastened to the vicinity of slot 154 on upper surface 156 of cylinder 122 with fixing bolt 164, and free end 170, which is bent from fixed portion 166 to shaft 136 side at an acute angle and extends toward upper inner surface 168 of closed container 102. Distal end portion 172 of free end 170 is close to upper inner surface 168 of closed container 102.

A plurality of coil springs 114 are provided below stator 152. In addition, at least one coil spring 114 is provided below stator 152 on a side opposite cylinder 122. Compressor main body 112 is elastically supported in closed container 102 by at least three coil springs 114 including a plurality of coil springs 114 which are provided below stator 152 on cylinder 122 side and at least one coil spring 114 which is provided below stator 152 on the side opposite cylinder 122.

Hereinafter, an operation and an effect of a closed compressor configured as described above will be described.

When electric connection between an inverter power supply (not shown) and electric unit 104 is established, a current flows through stator 152, a magnetic field is generated, and rotator 150 fixed to main shaft portion 138 rotates.

In addition, when rotator 150 rotates, shaft 136 rotates and thus piston 124 reciprocates in compression chamber 128 through connecting rod 148, which is rotatably attached to eccentric shaft portion 142, and compression unit 106 performs a predetermined compressing operation.

Next, an operation and an effect of flexible oil fence 162, which is provided on upper surface 156 of cylinder 122 on shaft 136 side, will be described.

When shaft 136 rotates, oil 108 that is pumped up from a lower end of shaft 136 passes through oil supply passage 146 and is scattered from upper end portion 144 of eccentric shaft portion 142 toward oil fence 162 as illustrated by arrows in FIGS. 1 and 3 due to a centrifugal force. Scattered oil 108 is held back by free end 170 of oil fence 162 and thus it is possible to prevent hot oil 108 from being sprinkled onto suction muffler 132 and flowing along a surface thereof. Therefore, refrigerant gas 110 passing through suction muffler 132 is prevented from being heated and thus it is possible to improve the volumetric efficiency of the closed compressor.

In addition, since oil fence 162 is formed by using a flexible resin film made of PET or the like, a collision sound can be prevented from being generated even in a case where distal end portion 172 of free end 170 that extends toward upper inner surface 168 of closed container 102 collides with upper inner surface 168 of closed container 102 due to the vibration of compression unit 106 which occurs when the closed compressor is activated or stopped. In addition, since it is possible to prevent oil fence 162 from being damaged, a gap between upper inner surface 168 of closed container 102 and upper surface 156 of cylinder 122 can be narrowed. Accordingly, it is possible to decrease the overall height of the closed compressor.

Next, an operation and an effect of fixed portion 166 of oil fence 162 being fixed to the vicinity of slot 154 that is present on upper surface 156 of cylinder 122 on shaft 136 side will be described.

Oil 108, which is scattered from upper end portion 144 of eccentric shaft portion 142 toward oil fence 162 as illustrated by the arrows in FIGS. 1 and 3 due to the centrifugal force, is held back by free end 170. Then, oil 108 which is held back flows down to upper surface 156 of cylinder 122 along a surface of free end 170 on shaft 136 side and is supplied to piston 124 along a side surface of slot 154 from chamfer 158. Accordingly, it is possible to increase the amount of oil supplied to piston 124, to improve lubrication of piston 124, and to improve the reliability.

Note that, slot 154 is formed into an earthenware mortar-like shape so that slot 154 is positioned at a lower position than upper surface 156 of cylinder 122. Accordingly, oil 108 flowing down to upper surface 156 of cylinder 122 can be caused to flow toward slot 154 side efficiently and it is possible to further improve the reliability of piston 124 with an increase in the amount of oil 108 supplied to piston 124.

Next, an operation and an effect of flexible oil fence 162 which is provided on upper surface 156 of cylinder 122 on shaft 136 pertaining to a case of an inverter-driving operation at a plurality of operation frequencies will be described.

At the time of high-speed rotation, the centrifugal force is increased. Therefore, oil 108 is scattered from upper end portion 144 of eccentric shaft portion 142 toward upper inner surface 168 of closed container 102 as illustrated by the arrows in FIGS. 1 and 3. However, oil 108 which is scattered in an upper space of closed container 102 is effectively held back by free end 170 of oil fence 162 since distal end portion 172 of free end 170 of oil fence 162 is close to upper inner surface 168 of closed container 102. Accordingly, it is possible to prevent hot oil 108 from being sprinkled onto suction muffler 132 and flowing along a surface thereof and to prevent refrigerant gas 110 passing through suction muffler 132 from being heated. Therefore, it is possible to more significantly improve the volumetric efficiency.

In addition, even when distal end portion 172 of oil fence 162 collides with upper inner surface 168 of closed container 102 due to the vibration of compression unit 106 at the time of a low-speed operation in which the vibration during the operation is intense, oil fence 162 can be prevented from being damaged since oil fence 162 is formed by using a flexible resin film made of PET or the like. Since it is possible to narrow a gap between upper inner surface 168 of closed container 102 and upper surface 156 of cylinder 122, it is possible to decrease the overall height of the closed compressor.

Note that, in the first embodiment, oil fence 162 is formed by using a flexible resin film made of PET or the like. However, it is possible to obtain the same effect even when oil fence 162 is formed by using flexible rubber or resin.

Second Embodiment

Figure 4:
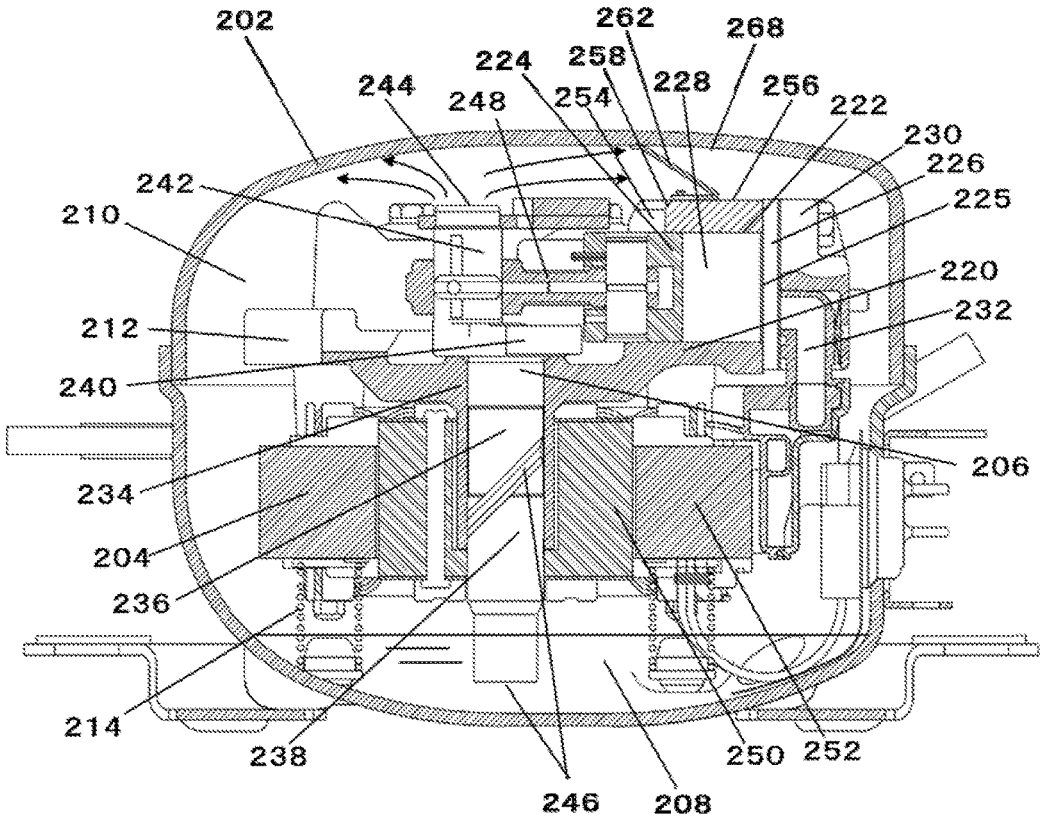
FIG. 4 is a longitudinal sectional view of a closed compressor according to a second embodiment of the invention.
Figure 5:
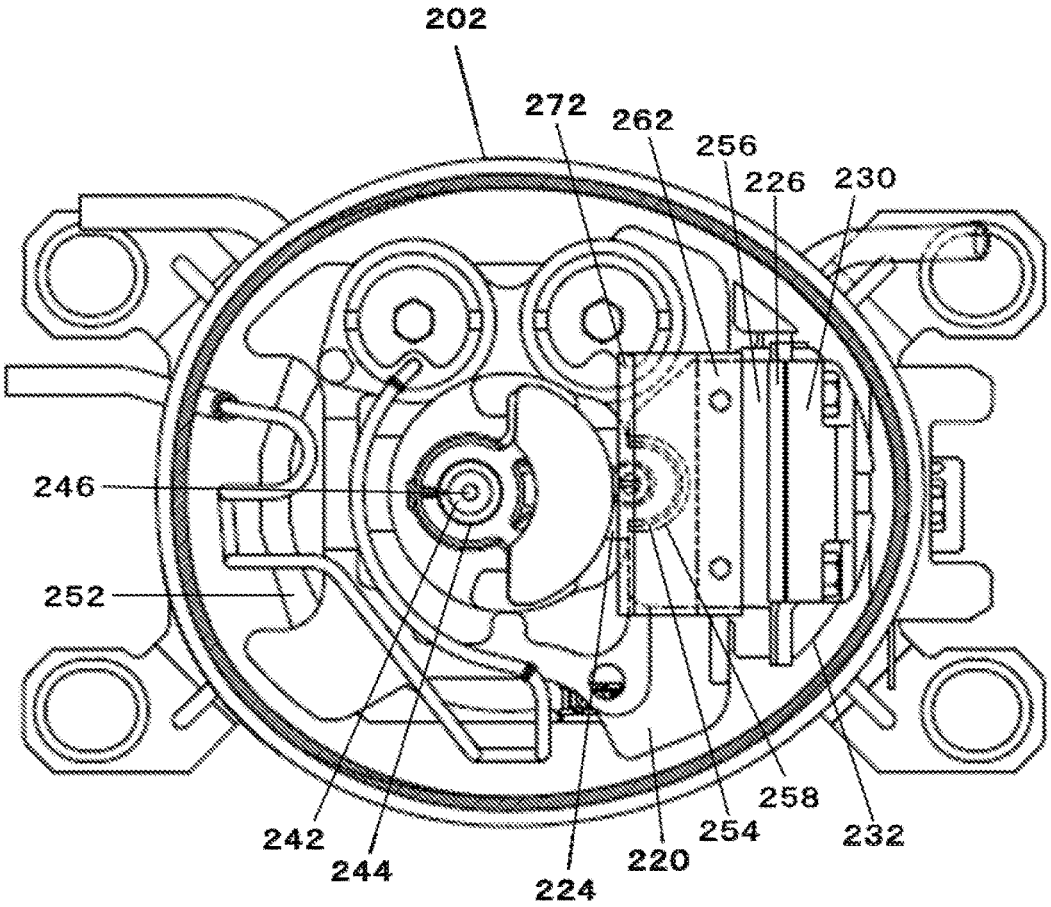
FIG. 5 is a top view obtained by cutting a closed container of the closed compressor according to the second embodiment of the invention in the lateral direction.
Figure 6:
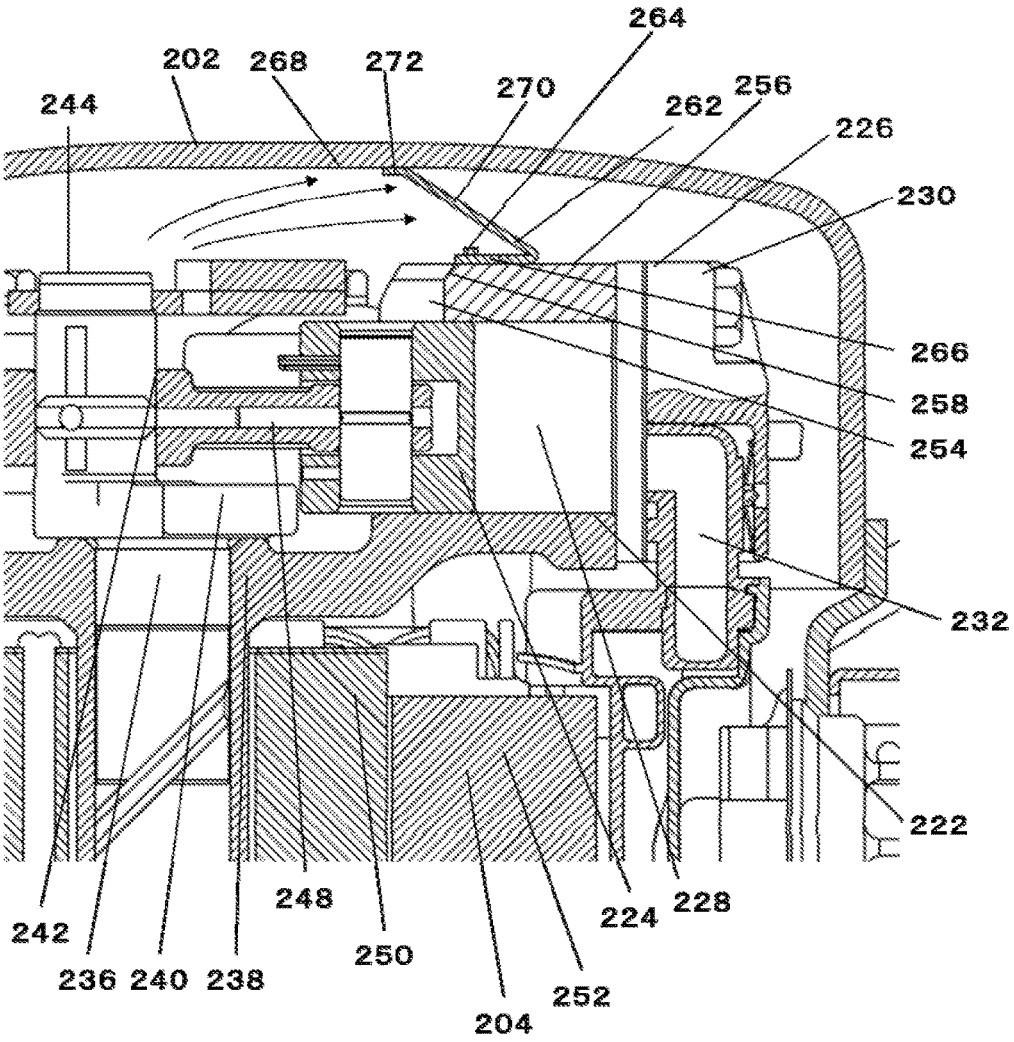
FIG. 6 is a sectional view illustrating a main portion of the closed compressor according to the second embodiment of the invention.

FIG. 4 is a longitudinal sectional view of a closed compressor according to a second embodiment of the invention and FIG. 5 is a top view obtained by cutting a closed container of the closed compressor according to the second embodiment of the invention in the lateral direction. FIG. 6 is a sectional view illustrating a main portion of the closed compressor according to the second embodiment of the invention.

In FIGS. 4 to 6, in the closed compressor according to the second embodiment, electric unit 204 and compression unit 206, which is driven by electric unit 204, are accommodated in closed container 202 which is formed through sheet metal drawing and oil 208 for lubrication is reserved in a bottom portion of closed container 202. Furthermore, closed container 202 is filled with, for example, refrigerant gas 210 such as hydrocarbon based R600a having a low global warming potential at a pressure equal to the pressure at a low pressure side of the refrigeration device (which will be described in FIG. 12) in a relatively low-temperature state.

Electric unit 204 and compression unit 206 are integrally assembled to configure compressor main body 212 and compressor main body 212 is elastically supported on a bottom surface in closed container 202 by at least three coil springs 214.

In cylinder block 220 constituting compression unit 206, hollow cylindrical cylinder 222 is formed and piston 224 is fitted into cylinder 222 such that piston 224 can freely reciprocate in cylinder 222.

Valve plate 226 is attached to open end 225 of cylinder 222 and valve plate 226 defines compression chamber 228 with cylinder 222 and piston 224. Furthermore, cylinder head 230 is fixed such that cylinder head 230 covers valve plate 226 and serves as a lid. Suction muffler 232 is formed of resin such as polybutylene terephthalate (PBT), includes a muffling space formed therein, is disposed below cylinder head 230, and is attached.

Main bearing 234 is formed at a lower portion of cylinder block 220.

Shaft 236 is constituted by main shaft portion 238 that is rotatably supported by main bearing 234 in a vertical direction, flange portion 240, and eccentric shaft portion 242 that is formed with flange portion 240 being interposed between main shaft portion 238 and eccentric shaft portion 242. Shaft 236 includes oil supply passage 246 through which a lower end of main shaft portion 238 communicates with upper end portion 244 of eccentric shaft portion 242. Furthermore, the lower end of main shaft portion 238 is immersed in oil 208 reserved in closed container 202 and upper end portion 244 of eccentric shaft portion 242 opens into closed container 202.

Cylinder 222 is disposed being separated from shaft 236 in a lateral direction.

Cylinder head 230 is disposed being further separated from shaft 236 in the lateral direction and is disposed beside cylinder 222.

Eccentric shaft portion 242 and piston 224 are connected to each other through connecting rod 248.

Electric unit 204 is a DC brushless motor that is constituted by rotator 250 which is fixed to main shaft portion 238 in a press-fitting manner or the like and stator 252 which is fastened to a lower portion of cylinder block 220 such that stator 252 surrounds the peripheral portion of rotator 250 while being coaxial with rotator 250.

Slot 254 which is cut out into a semi circular shape, a C-like shape, or an U-like shape as seen from the above in the vertical direction is formed on an upper side surface of cylinder 222 on shaft 236 side and chamfer 258 is provided on a corner at which slot 254 and upper surface 256 of cylinder 222 meet.

Piston 224 which reciprocates in cylinder 222 is disposed below slot 254.

Oil fence 262 which is formed by using a flexible resin film made of polyethylene terephthalate (PET) or the like is provided in the vicinity of slot 254 that is present on upper surface 256 of cylinder 222 on shaft 236 side.

Oil fence 262 is formed to include fixed portion 266 as one end and free end 270 as the other end.

Oil fence 262 is formed to include fixed portion 266, which is fastened to the vicinity of slot 254 on upper surface 256 of cylinder 222 with fixing bolt 264, free end 270, which is bent from fixed portion 266 to shaft 236 side at an acute angle and extends toward upper inner surface 268 of closed container 202, and distal end portion 272 as a distal end of free end 270 which comes into contact with upper inner surface 268 of closed container 202.

A plurality of coil springs 214 are provided below stator 252. In addition, at least one coil spring 214 is provided below stator 252 on a side opposite cylinder 222. Compressor main body 212 is elastically supported in closed container 202 by at least three coil springs 214 including a plurality of coil springs 214 which are provided below stator 252 on cylinder 222 side and at least one coil spring 214 which is provided below stator 252 on the side opposite cylinder 222.

Hereinafter, an operation and an effect of a closed compressor configured as described above will be described.

When electric connection between an inverter power supply (not shown) and electric unit 204 is established, a current flows through stator 252, a magnetic field is generated, and rotator 250 fixed to main shaft portion 238 rotates.

In addition, when rotator 250 rotates, shaft 236 rotates and thus piston 224 reciprocates in compression chamber 228 through connecting rod 248, which is rotatably attached to eccentric shaft portion 242, and compression unit 206 performs a predetermined compressing operation.

Next, an operation and an effect of flexible oil fence 262, which is provided on upper surface 256 of cylinder 222 on shaft 236 side, will be described.

When shaft 236 rotates, oil 208 that is pumped up from a lower end of shaft 236 passes through oil supply passage 246 and is scattered from upper end portion 244 of eccentric shaft portion 242 toward oil fence 262 as illustrated by arrows in FIGS. 4 and 6 due to a centrifugal force. Scattered oil 208 is held back by free end 270 of oil fence 262 and thus it is possible to prevent hot oil 208 from being sprinkled onto suction muffler 232 and flowing along a surface thereof. Therefore, refrigerant gas 210 passing through suction muffler 232 is prevented from being heated and thus it is possible to improve the volumetric efficiency of the closed compressor.

In addition, since oil fence 262 is formed by using a flexible resin film made of PET or the like and oil 208 is interposed between distal end portion 272 of oil fence 262 which is in contact with upper inner surface 268 of closed container 202 and upper inner surface 268 of closed container 202, it is possible to suppress wear even in a case where distal end portion 272 slides on upper inner surface 268 of closed container 202 due to the vibration of compression unit 206 which occurs when the closed compressor is activated or stopped. In addition, since it is possible to prevent oil fence 262 from being damaged, a gap between upper inner surface 268 of closed container 202 and upper surface 256 of cylinder 222 can be narrowed. Accordingly, it is possible to decrease the overall height of the closed compressor.

Next, an operation and an effect of fixed portion 266 of oil fence 262 being fixed to the vicinity of slot 254 that is present on upper surface 256 of cylinder 222 on shaft 236 side will be described.

A portion of oil 208 which adheres to upper inner surface 268 of closed container 202 is held back by distal end portion 272 of oil fence 262 and a portion of oil 208 which flies to free end 270 is held back by free end 270, the entire portion of oil 208 being scattered from upper end portion 244 of eccentric shaft portion 242 toward oil fence 262 as illustrated by the arrows in FIGS. 4 and 6 due to the centrifugal force. Then, oil 208 which is held back flows down to upper surface 256 of cylinder 222 along a surface of free end 270 on shaft 236 side and is supplied to piston 224 along a side surface of slot 254 from chamfer 258. Accordingly, it is possible to increase the amount of oil supplied to piston 224, to improve lubrication of piston 224, and to improve the reliability.

Note that, slot 254 is formed into an earthenware mortar-like shape so that slot 254 is positioned at a lower position than upper surface 256 of cylinder 222. Accordingly, oil 208 flowing down to upper surface 256 of cylinder 222 can be caused to flow toward slot 254 side efficiently and it is possible to further improve the reliability of piston 224 with an increase in the amount of oil 208 supplied to piston 224.

Next, an operation and an effect of flexible oil fence 262 which is provided on upper surface 256 of cylinder 222 on shaft 236 pertaining to a case of an inverter-driving operation at a plurality of operation frequencies will be described.

At the time of a high-speed operation, the centrifugal force is increased. Therefore, oil 208 is scattered from upper end portion 244 of eccentric shaft portion 242 toward upper inner surface 268 of closed container 202 as illustrated by the arrows in FIGS. 4 and 6. However, oil 208 which is scattered in an upper space of closed container 202 and adheres to upper inner surface 268 of closed container 202 is effectively held back by distal end portion 272 since distal end portion 272 of oil fence 262 is in contact with upper inner surface 268 of closed container 202. Accordingly, it is possible to prevent hot oil 208 from being sprinkled onto suction muffler 232 and flowing along a surface thereof and to prevent refrigerant gas 210 passing through suction muffler 232 from being heated. Therefore, it is possible to more significantly improve the volumetric efficiency.

In addition, oil fence 262 is formed by using a flexible resin film made of PET or the like and oil 208 is interposed between distal end portion 272 of oil fence 262 and upper inner surface 268 of closed container 202 at the time of a low-speed operation in which the vibration during the operation is intense. Accordingly, it is possible to prevent wear or damage even when distal end portion 272 and upper inner surface 268 of closed container 202 vibrate in accordance with the vibration of compression unit 206, and thus a gap between upper inner surface 268 of closed container 202 and upper surface 256 of cylinder 222 can be narrowed. Accordingly, it is possible to decrease the overall height of the closed compressor.

Note that, in the second embodiment, oil fence 262 is formed by using a flexible resin film made of PET or the like. However, it is possible to obtain the same effect even when oil fence 262 is formed by using flexible rubber or resin.

Third Embodiment

Figure 7:
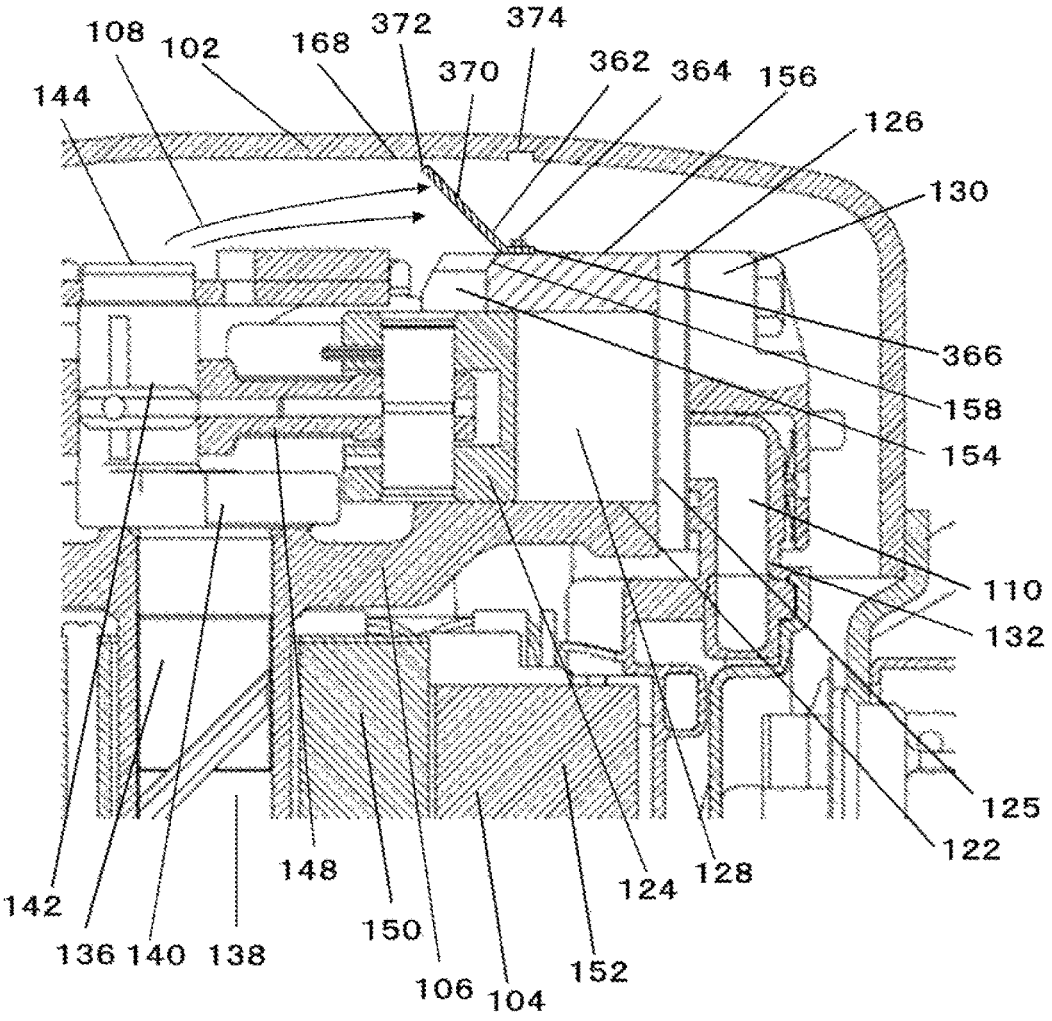
FIG. 7 is a sectional view illustrating a main portion of a closed compressor according to a third embodiment of the invention.

FIG. 7 is a sectional view illustrating a main portion of a closed compressor according to a third embodiment of the invention.

In FIG. 7, constituent elements (components) of the closed compressor according to the third embodiment which are the same as those of the closed compressor according to the first embodiment are given the same reference numbers and description thereof will be omitted.

Oil fence 362 which is formed by using a flexible resin film made of polyethylene terephthalate (PET) or the like is provided in the vicinity of slot 154 that is present on upper surface 156 of cylinder 122 on shaft 136 side.

Oil fence 362 is formed to include fixed portion 366 as one end and free end 370 as the other end.

Oil fence 362 is formed to include fixed portion 366, which is fastened to the vicinity of slot 154 on upper surface 156 of cylinder 122 with fixing bolt 364, and free end 370, which is bent from fixed portion 366 to shaft 136 side at an obtuse angle, has a flat surface of which the longitudinal section is straight line-shaped, and extends toward upper inner surface 168 of closed container 102. Distal end portion 372 of free end 370 is close to upper inner surface 168 of closed container 102.

In a longitudinal section, an obtuse angle between fixed portion 366 and free end 370 faces an obtuse angle between upper surface 156 of cylinder 122 and chamfer 158. The vertex of the obtuse angle between fixed portion 366 and free end 370 coincides with the vertex of the obtuse angle between upper surface 156 of cylinder 122 and chamfer 158 at one point.

Although the description made here indicates that the vertex of the obtuse angle between fixed portion 366 and free end 370 meets the vertex of the obtuse angle between upper surface 156 of cylinder 122 and chamfer 158 at one point, the vertex of the obtuse angle between fixed portion 366 and free end 370 may meet the vertex of the obtuse angle between upper surface 156 of cylinder 122 and chamfer 158 at two points with fixed portion 366 being disposed above slot 154.

Concave portion 374 is above fixed portion 366 and is formed on upper inner surface 168 of closed container 102.

Concave portion 374 is recessed into a groove-like shape of which the size is sufficient to accommodate distal end portion 372 of free end 370 of oil fence 362.

Regarding the closed compressor configured as described above, an operation and an effect of flexible oil fence 362 will be described.

When shaft 136 rotates, oil 108 that is pumped up from a lower end of shaft 136 passes through oil supply passage 146 and is scattered from upper end portion 144 of eccentric shaft portion 142 toward oil fence 362 as illustrated by arrows in FIG. 7 due to a centrifugal force. Scattered oil 108 is held back by free end 370 of oil fence 362 and thus it is possible to prevent hot oil 108 from being sprinkled onto suction muffler 132 and flowing along a surface thereof. Therefore, refrigerant gas 110 passing through suction muffler 132 is prevented from being heated and thus it is possible to improve the volumetric efficiency of the closed compressor.

When compression unit 106 vibrates upward due to the vibration of compression unit 106 which occurs when the closed compressor is activated or stopped, distal end portion 372 of free end 370 of oil fence 362 comes into contact with upper inner surface 168 of closed container 102. In the state of contact, an angle between upper inner surface 168 of closed container 102 on eccentric shaft portion 142 side and free end 370 of oil fence 362 becomes an obtuse angle. When compression unit 106 vibrates further upward, free end 370 of oil fence 362 is bent. When compression unit 106 vibrates still further upward, since an angle between upper inner surface 168 and free end 370 of oil fence 362 is an obtuse angle, distal end portion 372 of oil fence 362 slides on upper inner surface 168 of closed container 102 toward eccentric shaft portion 142 side.

Here, oil fence 362 is formed by using a flexible resin film made of polyethylene terephthalate (PET) or the like. A collision sound can be prevented from being generated even in a case where distal end portion 372 of free end 370 that extends toward upper inner surface 168 of closed container 102 collides with upper inner surface 168 of closed container 102 due to the vibration of compression unit 106 which occurs when the closed compressor is activated or stopped. In addition, since it is possible to prevent oil fence 362 from being damaged, a gap between upper inner surface 168 of closed container 102 and upper surface 156 of cylinder 122 can be narrowed. Accordingly, it is possible to decrease the overall height of the closed compressor.

Next, an operation and an effect of fixed portion 366 of oil fence 362 being fixed to the vicinity of slot 154 that is present on upper surface 156 of cylinder 122 on shaft 136 side will be described.

Oil 108, which is scattered from upper end portion 144 of eccentric shaft portion 142 toward oil fence 362 as illustrated by the arrows in FIG. 7 due to the centrifugal force, is held back by free end 370. Then, oil 108 which is held back flows down to chamfer 158 of slot 154 along a surface of free end 370 on shaft 136 side and is supplied to piston 124 along a side surface of slot 154 from chamfer 158. Accordingly, it is possible to increase the amount of oil supplied to piston 124, to improve lubrication of piston 124, and to improve the reliability.

Note that, slot 154 is provided with chamfer 158 and is formed into an earthenware mortar-like shape so that slot 154 is positioned at a lower position than upper surface 156 of cylinder 122. Accordingly, oil 108 flowing down to upper surface 156 of cylinder 122 can be caused to flow toward slot 154 side efficiently and it is possible to further improve the reliability of piston 124 with an increase in the amount of oil 108 supplied to piston 124.

Next, an operation and an effect of flexible oil fence 362 which is provided on upper surface 156 of cylinder 122 on shaft 136 side pertaining to a case of an inverter-driving operation at a plurality of operation frequencies will be described.

At the time of high-speed rotation, the centrifugal force is increased. Therefore, oil 108 is scattered from upper end portion 144 of eccentric shaft portion 142 toward upper inner surface 168 of closed container 102 as illustrated by the arrows in FIG. 7. However, oil 108 which is scattered in an upper space of closed container 102 is effectively held back by free end 370 of oil fence 362 since distal end portion 372 of free end 370 of oil fence 362 is close to upper inner surface 168 of closed container 102. Accordingly, it is possible to prevent hot oil 108 from being sprinkled onto suction muffler 132 and flowing along a surface thereof and to prevent refrigerant gas 110 passing through suction muffler 132 from being heated. Therefore, it is possible to more significantly improve the volumetric efficiency.

In addition, even when distal end portion 372 of oil fence 362 collides with upper inner surface 168 of closed container 102 due to the vibration of compression unit 106 at the time of a low-speed operation in which the vibration during the operation is intense, oil fence 362 can be prevented from being damaged since oil fence 362 is formed by using a flexible resin film made of PET or the like. Since it is possible to narrow a gap between upper inner surface 168 of closed container 102 and upper surface 156 of cylinder 122, it is possible to decrease the overall height of the closed compressor.

Next, an operation and an effect of flexible oil fence 362 and concave portion 374 formed on upper inner surface 168 of closed container 102 will be described.

Concave portion 374 formed above fixed portion 366 of oil fence 362 is not necessary if the closed compressor is transported in a normal manner. However, when distal end portion 372 of oil fence 362 on eccentric shaft portion 142 side is extremely moved toward cylinder head 130 side with the closed compressor being transported in an abnormal manner in which a force is rapidly applied to the closed compressor, it is not possible to hold back oil 108 sufficiently.

Therefore, concave portion 374 is above fixed portion 366 of oil fence 362 and is formed on upper inner surface 168 of closed container 102 so that distal end portion 372 of oil fence 362 is not extremely moved toward cylinder head 130 side. Concave portion 374 is formed to have a size which is sufficient to accommodate distal end portion 372 of oil fence 362.

Since distal end portion 372 of oil fence 362 is accommodated in concave portion 374 when distal end portion 372 of oil fence 362 is moved toward cylinder head 130 side with the closed compressor being transported in an abnormal manner in which a force is rapidly applied to the closed compressor, it is possible to prevent distal end portion 372 of oil fence 362 from moving toward cylinder head 130 side. As a result, it is possible to hold back hot oil 108 efficiently with free end 370 of oil fence 362. Accordingly, it is possible to prevent hot oil 108 from being sprinkled onto suction muffler 132 and flowing along a surface thereof and to prevent refrigerant gas 110 passing through suction muffler 132 from being heated. Therefore, it is possible to more significantly improve the volumetric efficiency.

Note that, in the third embodiment, oil fence 162 is formed by using a flexible resin film made of PET or the like. However, it is possible to obtain the same effect even when oil fence 162 is formed by using flexible rubber or resin.

Fourth Embodiment

Figure 8:
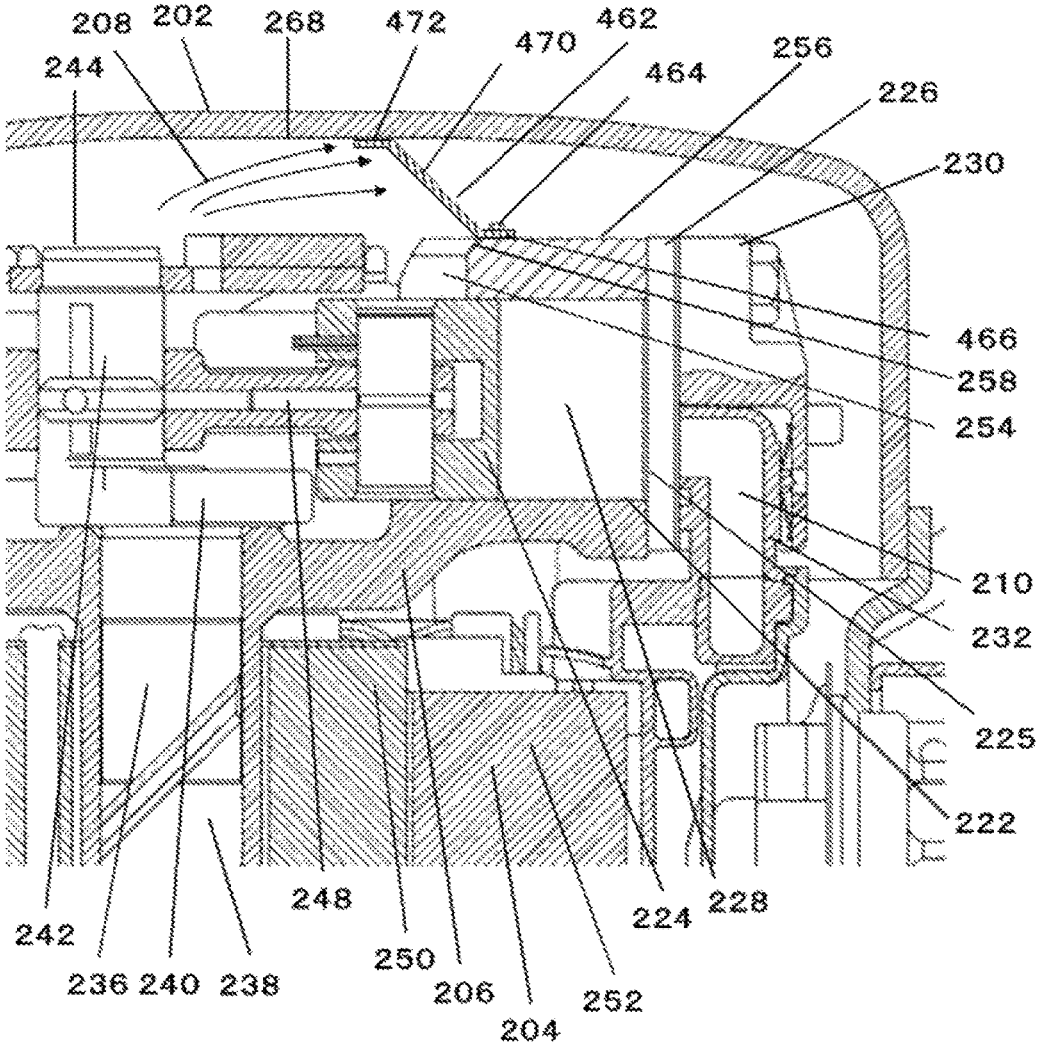
FIG. 8 is a sectional view illustrating a main portion of a closed compressor according to a fourth embodiment of the invention.

FIG. 8 is a sectional view illustrating a main portion of a closed compressor according to a fourth embodiment of the invention.

In FIG. 8, constituent elements (components) of the closed compressor according to the fourth embodiment which are the same as those of the closed compressor according to the second embodiment are given the same reference numbers and description thereof will be omitted.

Oil fence 462 which is formed by using a flexible resin film made of polyethylene terephthalate (PET) or the like is provided in the vicinity of slot 254 that is present on upper surface 256 of cylinder 222 on shaft 236 side.

Oil fence 462 is formed to include fixed portion 466 as one end and free end 470 as the other end.

Oil fence 462 is formed to include fixed portion 466, which is fastened to the vicinity of slot 254 on upper surface 256 of cylinder 222 with fixing bolt 464, free end 470, which is bent from fixed portion 466 to shaft 236 side at an obtuse angle, has a flat surface of which the longitudinal section is straight line-shaped, and extends toward upper inner surface 268 of closed container 202, and distal end portion 472 as a distal end of free end 470 which comes into contact with upper inner surface 268 of closed container 202.

In a longitudinal section, an obtuse angle between fixed portion 466 and free end 470 faces an obtuse angle between upper surface 256 of cylinder 222 and chamfer 258. The vertex of the obtuse angle between fixed portion 466 and free end 470 coincides with the vertex of the obtuse angle between upper surface 256 of cylinder 222 and chamfer 258 at one point.

Although the description made here indicates that the vertex of the obtuse angle between fixed portion 466 and free end 470 meets the vertex of the obtuse angle between upper surface 256 of cylinder 222 and chamfer 258 at one point, the vertex of the obtuse angle between fixed portion 466 and free end 470 may meet the vertex of the obtuse angle between upper surface 256 of cylinder 222 and chamfer 258 at two points with fixed portion 466 being disposed above slot 254.

Regarding the closed compressor configured as described above, an operation and an effect of flexible oil fence 462 will be described.

When shaft 236 rotates, oil 208 that is pumped up from a lower end of shaft 236 passes through oil supply passage 246 and is scattered from upper end portion 244 of eccentric shaft portion 242 toward oil fence 462 as illustrated by arrows in FIG. 8 due to a centrifugal force. Scattered oil 208 is held back by free end 470 of oil fence 462 and thus it is possible to prevent hot oil 208 from being sprinkled onto suction muffler 232 and flowing along a surface thereof. Therefore, refrigerant gas 210 passing through suction muffler 232 is prevented from being heated and thus it is possible to improve the volumetric efficiency of the closed compressor.

An angle between upper inner surface 268 of closed container 202 on eccentric shaft portion 242 side and free end 470 of oil fence 462 is an obtuse angle.

When compression unit 206 vibrates upward due to the vibration of compression unit 206 which occurs when the closed compressor is activated or stopped, free end 470 of oil fence 462 is bent. When compression unit 206 vibrates further upward, since an angle between upper inner surface 268 and free end 470 of oil fence 462 is an obtuse angle, distal end portion 472 of free end 470 of oil fence 462 slides on upper inner surface 268 of closed container 202 toward eccentric shaft portion 242 side.

Here, oil fence 462 is formed by using a flexible resin film made of polyethylene terephthalate (PET) or the like. Since oil 208 is interposed between distal end portion 472 of oil fence 462 which is in contact with upper inner surface 268 of closed container 202 and upper inner surface 268 of closed container 202, it is possible to suppress wear even in a case where distal end portion 472 slides on upper inner surface 268 of closed container 202 due to the vibration of compression unit 206 which occurs when the closed compressor is activated or stopped. In addition, since it is possible to prevent oil fence 462 from being damaged, a gap between upper inner surface 268 of closed container 202 and upper surface 256 of cylinder 222 can be narrowed. Accordingly, it is possible to decrease the overall height of the closed compressor.

Next, an operation and an effect of fixed portion 466 of oil fence 462 being fixed to the vicinity of slot 254 that is present on upper surface 256 of cylinder 222 on shaft 236 side will be described.

A portion of oil 208 which adheres to upper inner surface 268 of closed container 202 is held back by distal end portion 472 of oil fence 462 and a portion of oil 208 which flies to free end 470 is held back by free end 470, the entire portion of oil 208 being scattered from upper end portion 244 of eccentric shaft portion 242 toward oil fence 462 as illustrated by the arrows in FIG. 8 due to the centrifugal force. Then, oil 208 which is held back flows down to chamfer 258 of slot 254 along a surface of free end 470 on shaft 236 side and is supplied to piston 224 along a side surface of slot 254 from chamfer 258. Accordingly, it is possible to increase the amount of oil supplied to piston 224, to improve lubrication of piston 224, and to improve the reliability.

Note that, slot 254 is provided with chamfer 258 and is formed into an earthenware mortar-like shape so that slot 254 is positioned at a lower position than upper surface 256 of cylinder 222. Accordingly, oil 208 flowing down to upper surface 256 of cylinder 222 can be caused to flow toward slot 254 side efficiently and it is possible to further improve the reliability of piston 224 with an increase in the amount of oil 208 supplied to piston 224.

Next, an operation and an effect of flexible oil fence 462 which is provided on upper surface 256 of cylinder 222 on shaft 236 side pertaining to a case of an inverter-driving operation at a plurality of operation frequencies will be described.

At the time of a high-speed operation, the centrifugal force is increased. Therefore, oil 208 is scattered from upper end portion 244 of eccentric shaft portion 242 toward upper inner surface 268 of closed container 202 as illustrated by the arrows in FIG. 8. However, oil 208 which is scattered in an upper space of closed container 202 and adheres to upper inner surface 268 of closed container 202 is effectively held back by distal end portion 472 since distal end portion 472 of oil fence 462 is in contact with upper inner surface 268 of closed container 202. Accordingly, it is possible to prevent hot oil 208 from being sprinkled onto suction muffler 232 and flowing along a surface thereof and to prevent refrigerant gas 210 passing through suction muffler 232 from being heated. Therefore, it is possible to more significantly improve the volumetric efficiency.

In addition, oil fence 462 is formed by using a flexible resin film made of PET or the like and oil is interposed between distal end portion 472 of oil fence 462 and upper inner surface 268 of closed container 202 at the time of a low-speed operation in which the vibration during the operation is intense. Accordingly, it is possible to prevent wear or damage even when distal end portion 472 and upper inner surface 268 of closed container 202 vibrate in accordance with the vibration of compression unit 206, and thus a gap between upper inner surface 268 of closed container 202 and upper surface 256 of cylinder 222 can be narrowed. Accordingly, it is possible to decrease the overall height of the closed compressor.

Note that, in the fourth embodiment, oil fence 462 is formed by using a flexible resin film made of PET or the like. However, it is possible to obtain the same effect even when oil fence 462 is formed by using flexible rubber or resin.

Fifth Embodiment

Figure 9:
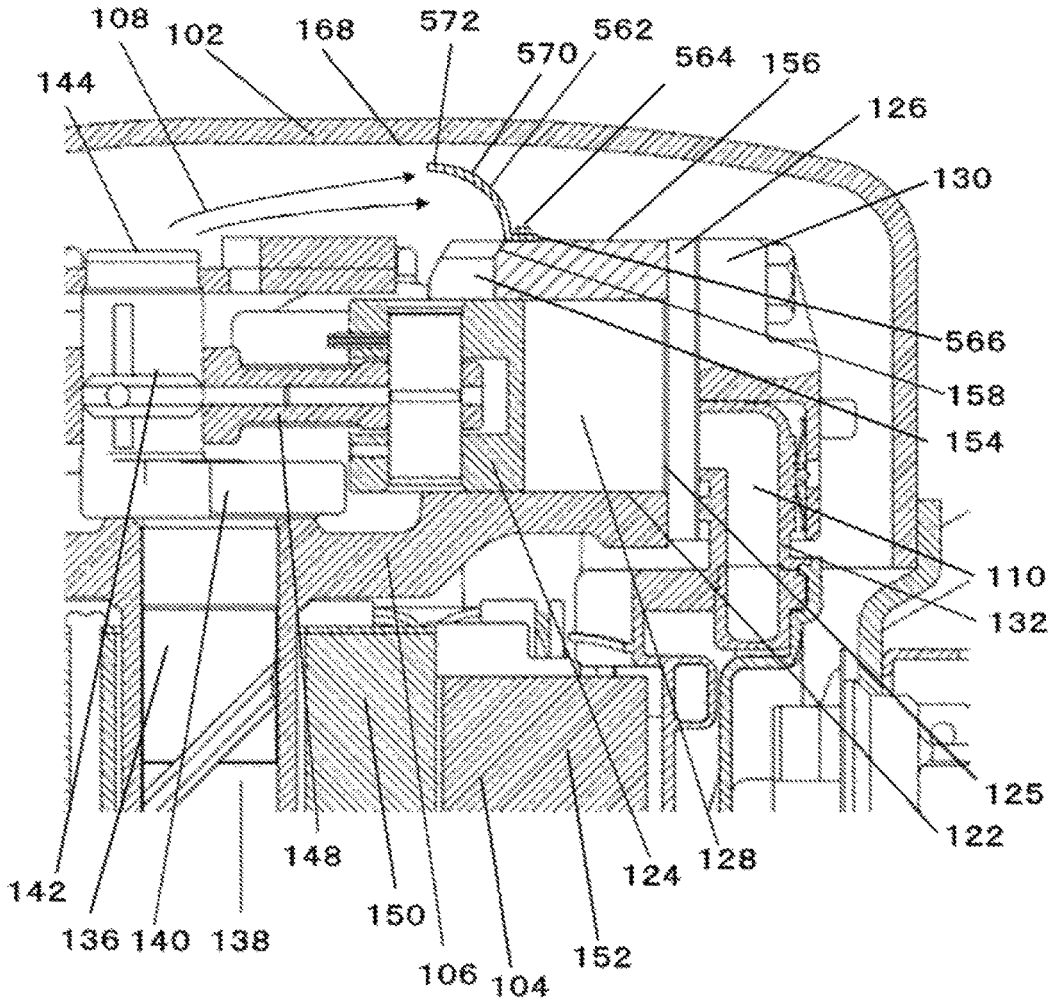
FIG. 9 is a sectional view illustrating a main portion of a closed compressor according to a fifth embodiment of the invention.

FIG. 9 is a sectional view illustrating a main portion of a closed compressor according to a fifth embodiment of the invention.

In FIG. 9, constituent elements (components) of the closed compressor according to the fifth embodiment which are the same as those of the closed compressor according to the first embodiment are given the same reference numbers and description thereof will be omitted.

Oil fence 562 which is formed by using a flexible resin film made of polyethylene terephthalate (PET) or the like is provided in the vicinity of slot 154 that is present on upper surface 156 of cylinder 122 on shaft 136 side.

Oil fence 562 is formed to include fixed portion 566 as one end and free end 570 as the other end.

Oil fence 562 is formed to include fixed portion 566, which is fastened to the vicinity of slot 154 on upper surface 156 of cylinder 122 with fixing bolt 564, and free end 570, which is bent from fixed portion 566 to shaft 136 side at an obtuse angle, has a curved surface of which the longitudinal section is curved line-shaped, and extends toward upper inner surface 168 of closed container 102. Distal end portion 572 of free end 570 is close to upper inner surface 168 of closed container 102.

In a longitudinal section, an obtuse angle between fixed portion 566 and free end 570 faces an obtuse angle between upper surface 156 of cylinder 122 and chamfer 158. The vertex of the obtuse angle between fixed portion 566 and free end 570 coincides with the vertex of the obtuse angle between upper surface 156 of cylinder 122 and chamfer 158 at one point.

Although the description made here indicates that the vertex of the obtuse angle between fixed portion 566 and free end 570 meets the vertex of the obtuse angle between upper surface 156 of cylinder 122 and chamfer 158 at one point, the vertex of the obtuse angle between fixed portion 566 and free end 570 may meet the vertex of the obtuse angle between upper surface 156 of cylinder 122 and chamfer 158 at two points with fixed portion 566 being disposed above slot 154.

Regarding the closed compressor configured as described above, an operation and an effect of flexible oil fence 562 will be described.

When shaft 136 rotates, oil 108 that is pumped up from a lower end of shaft 136 passes through oil supply passage 146 and is scattered from upper end portion 144 of eccentric shaft portion 142 toward oil fence 562 as illustrated by arrows in FIG. 9 due to a centrifugal force. Scattered oil 108 is held back by free end 570 of oil fence 562 and thus it is possible to prevent hot oil 108 from being sprinkled onto suction muffler 132 and flowing along a surface thereof. Therefore, refrigerant gas 110 passing through suction muffler 132 is prevented from being heated and thus it is possible to improve the volumetric efficiency of the closed compressor.

When compression unit 106 vibrates upward due to the vibration of compression unit 106 which occurs when the closed compressor is activated or stopped, distal end portion 572 of oil fence 562 comes into contact with upper inner surface 168 of closed container 102. In the state of contact, an angle between upper inner surface 168 of closed container 102 on eccentric shaft portion 142 side and free end 570 of oil fence 562 becomes an obtuse angle. When compression unit 106 vibrates further upward, free end 570 of oil fence 562 is bent. When compression unit 106 vibrates still further upward, since an angle between upper inner surface 168 and free end 570 of oil fence 562 is an obtuse angle, distal end portion 572 of free end 570 of oil fence 562 slides on upper inner surface 168 of closed container 102 toward eccentric shaft portion 142 side.

Here, oil fence 562 is formed by using a flexible resin film made of polyethylene terephthalate (PET) or the like. A collision sound can be prevented from being generated even in a case where distal end portion 572 of free end 570 that extends toward upper inner surface 168 of closed container 102 collides with upper inner surface 168 of closed container 102 due to the vibration of compression unit 106 which occurs when the closed compressor is activated or stopped. In addition, since it is possible to prevent oil fence 562 from being damaged, a gap between upper inner surface 168 of closed container 102 and upper surface 156 of cylinder 122 can be narrowed. Accordingly, it is possible to decrease the overall height of the closed compressor.

Next, an operation and an effect of fixed portion 566 of oil fence 562 being fixed to the vicinity of slot 154 that is present on upper surface 156 of cylinder 122 on shaft 136 side will be described.

Oil 108, which is scattered from upper end portion 144 of eccentric shaft portion 142 toward oil fence 562 as illustrated by the arrows in FIG. 9 due to the centrifugal force, is held back by free end 570. Then, oil 108 which is held back flows down to chamfer 158 of slot 154 along a surface of free end 570 on shaft 136 side and is supplied to piston 124 along a side surface of slot 154 from chamfer 158. Accordingly, it is possible to increase the amount of oil supplied to piston 124, to improve lubrication of piston 124, and to improve the reliability.

Note that, slot 154 is provided with chamfer 158 and is formed into an earthenware mortar-like shape so that slot 154 is positioned at a lower position than upper surface 156 of cylinder 122. Accordingly, oil 108 flowing down to upper surface 156 of cylinder 122 can be caused to flow toward slot 154 side efficiently and it is possible to further improve the reliability of piston 124 with an increase in the amount of oil 108 supplied to piston 124.

Next, an operation and an effect of flexible oil fence 562 which is provided on upper surface 156 of cylinder 122 on shaft 136 side pertaining to a case of an inverter-driving operation at a plurality of operation frequencies will be described.

At the time of high-speed rotation, the centrifugal force is increased. Therefore, oil 108 is scattered from upper end portion 144 of eccentric shaft portion 142 toward upper inner surface 168 of closed container 102 as illustrated by the arrows in FIG. 9. However, oil 108 which is scattered in an upper space of closed container 102 is effectively held back by free end 570 of oil fence 562 since distal end portion 572 of free end 570 of oil fence 562 is close to upper inner surface 168 of closed container 102. Accordingly, it is possible to prevent hot oil 108 from being sprinkled onto suction muffler 132 and flowing along a surface thereof and to prevent refrigerant gas 110 passing through suction muffler 132 from being heated. Therefore, it is possible to more significantly improve the volumetric efficiency.

In addition, even when distal end portion 572 of oil fence 562 collides with upper inner surface 168 of closed container 102 due to the vibration of compression unit 106 at the time of a low-speed operation in which the vibration during the operation is intense, oil fence 562 can be prevented from being damaged since oil fence 562 is formed by using a flexible resin film made of PET or the like. Since it is possible to narrow a gap between upper inner surface 168 of closed container 102 and upper surface 156 of cylinder 122, it is possible to decrease the overall height of the closed compressor.

Note that, in the fifth embodiment, oil fence 162 is formed by using a flexible resin film made of PET or the like. However, it is possible to obtain the same effect even when oil fence 162 is formed by using flexible rubber or resin.

Sixth Embodiment

Figure 10:
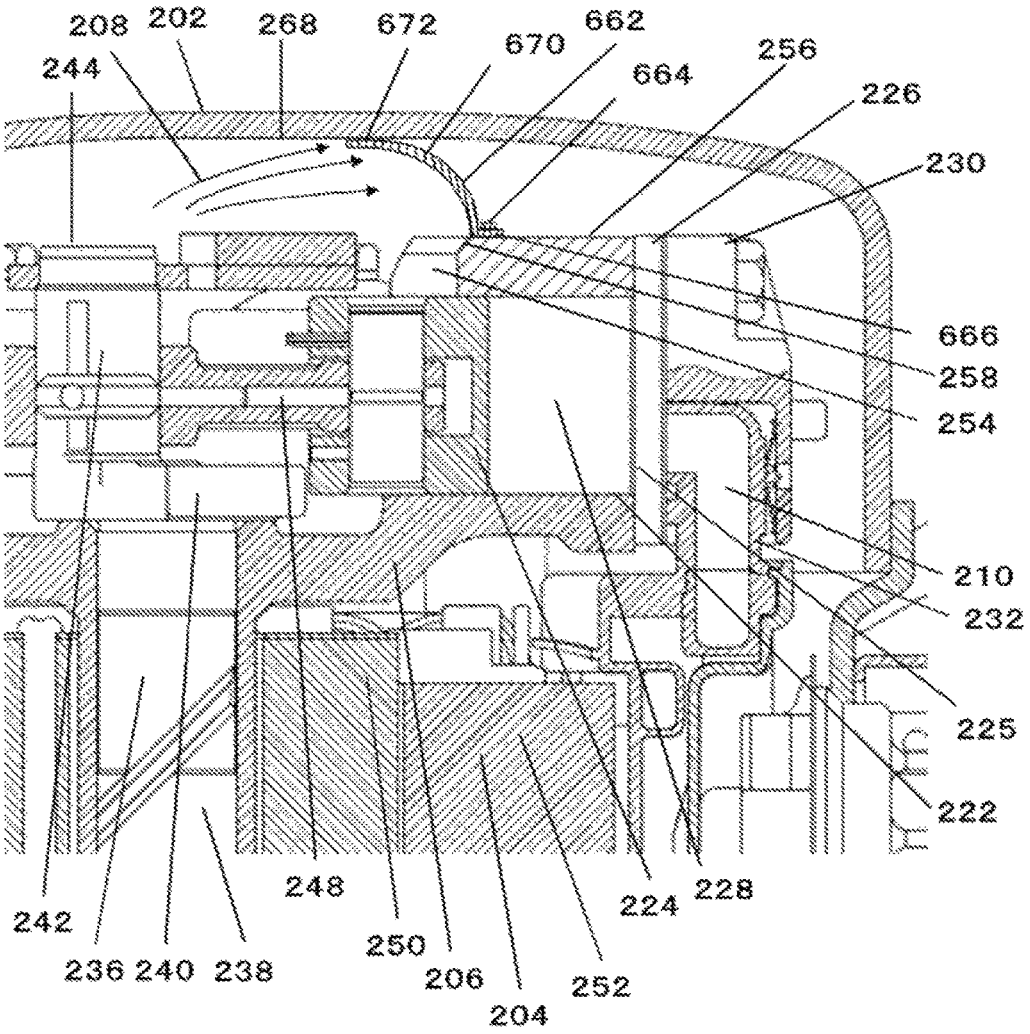
FIG. 10 is a sectional view illustrating a main portion of a closed compressor according to a sixth embodiment of the invention.

FIG. 10 is a sectional view illustrating a main portion of a closed compressor according to a sixth embodiment of the invention.

In FIG. 10, constituent elements (components) of the closed compressor according to the sixth embodiment which are the same as those of the closed compressor according to the second embodiment are given the same reference numbers and description thereof will be omitted.

Oil fence 662 which is formed by using a flexible resin film made of polyethylene terephthalate (PET) or the like is provided in the vicinity of slot 254 that is present on upper surface 256 of cylinder 222 on shaft 236 side.

Oil fence 662 is formed to include fixed portion 666 as one end and free end 670 as the other end.

Oil fence 662 is formed to include fixed portion 666, which is fastened to the vicinity of slot 254 on upper surface 256 of cylinder 222 with fixing bolt 664, free end 670, which is bent from fixed portion 666 to shaft 236 side at an obtuse angle, has a curved surface of which the longitudinal section is curved line-shaped, and extends toward upper inner surface 268 of closed container 202, and distal end portion 672 as a distal end of free end 670 which comes into contact with upper inner surface 268 of closed container 202.

In a longitudinal section, an obtuse angle between fixed portion 666 and free end 670 faces an obtuse angle between upper surface 256 of cylinder 222 and chamfer 258. The vertex of the obtuse angle between fixed portion 666 and free end 670 coincides with the vertex of the obtuse angle between upper surface 256 of cylinder 222 and chamfer 258 at one point.

Although the description made here indicates that the vertex of the obtuse angle between fixed portion 666 and free end 670 meets the vertex of the obtuse angle between upper surface 256 of cylinder 222 and chamfer 258 at one point, the vertex of the obtuse angle between fixed portion 666 and free end 670 may meet the vertex of the obtuse angle between upper surface 256 of cylinder 222 and chamfer 258 at two points with fixed portion 666 being disposed above slot 254.

Regarding the closed compressor configured as described above, an operation and an effect of flexible oil fence 662 will be described.

When shaft 236 rotates, oil 208 that is pumped up from a lower end of shaft 236 passes through oil supply passage 246 and is scattered from upper end portion 244 of eccentric shaft portion 242 toward oil fence 662 as illustrated by arrows in FIG. 10 due to a centrifugal force. Scattered oil 208 is held back by free end 670 of oil fence 662 and thus it is possible to prevent hot oil 208 from being sprinkled onto suction muffler 232 and flowing along a surface thereof. Therefore, refrigerant gas 210 passing through suction muffler 232 is prevented from being heated and thus it is possible to improve the volumetric efficiency of the closed compressor.

An angle between upper inner surface 268 of closed container 202 on eccentric shaft portion 242 side and free end 670 of oil fence 662 is an obtuse angle.

When compression unit 206 vibrates upward due to the vibration of compression unit 206 which occurs when the closed compressor is activated or stopped, free end 670 of oil fence 662 is bent. When compression unit 206 vibrates further upward, since an angle between upper inner surface 268 and free end 670 of oil fence 662 is an obtuse angle, distal end portion 672 of free end 670 of oil fence 662 slides on upper inner surface 268 of closed container 202 toward eccentric shaft portion 242 side.

Here, oil fence 662 is formed by using a flexible resin film made of polyethylene terephthalate (PET) or the like. Since oil 208 is interposed between distal end portion 672 of oil fence 662 which is in contact with upper inner surface 268 of closed container 202 and upper inner surface 268 of closed container 202, it is possible to suppress wear even in a case where distal end portion 672 slides on upper inner surface 268 of closed container 202 due to the vibration of compression unit 206 which occurs when the closed compressor is activated or stopped. In addition, since it is possible to prevent oil fence 662 from being damaged, a gap between upper inner surface 268 of closed container 202 and upper surface 256 of cylinder 222 can be narrowed. Accordingly, it is possible to decrease the overall height of the closed compressor.

Next, an operation and an effect of fixed portion 666 of oil fence 662 being fixed to the vicinity of slot 254 that is present on upper surface 256 of cylinder 222 on shaft 236 side will be described.

A portion of oil 208 which adheres to upper inner surface 268 of closed container 202 is held back by distal end portion 672 of oil fence 662 and a portion of oil 208 which flies to free end 670 is held back by free end 670, the entire portion of oil 208 being scattered from upper end portion 244 of eccentric shaft portion 242 toward oil fence 662 as illustrated by the arrows in FIG. 10 due to the centrifugal force. Then, oil 208 which is held back flows down to chamfer 258 of slot 254 along a surface of free end 670 on shaft 236 side and is supplied to piston 224 along a side surface of slot 254 from chamfer 258. Accordingly, it is possible to increase the amount of oil supplied to piston 224, to improve lubrication of piston 224, and to improve the reliability.

Note that, slot 254 is provided with chamfer 258 and is formed into an earthenware mortar-like shape so that slot 254 is positioned at a lower position than upper surface 256 of cylinder 222. Accordingly, oil 208 flowing down to upper surface 256 of cylinder 222 can be caused to flow toward slot 254 side efficiently and it is possible to further improve the reliability of piston 224 with an increase in the amount of oil 208 supplied to piston 224.

Next, an operation and an effect of flexible oil fence 662 which is provided on upper surface 256 of cylinder 222 on shaft 236 side pertaining to a case of an inverter-driving operation at a plurality of operation frequencies will be described.

At the time of a high-speed operation, the centrifugal force is increased. Therefore, oil 208 is scattered from upper end portion 244 of eccentric shaft portion 242 toward upper inner surface 268 of closed container 202 as illustrated by the arrows in FIG. 10. However, oil 208 which is scattered in an upper space of closed container 202 and adheres to upper inner surface 268 of closed container 202 is effectively held back by distal end portion 672 since distal end portion 672 of oil fence 662 is in contact with upper inner surface 268 of closed container 202. Accordingly, it is possible to prevent hot oil 208 from being sprinkled onto suction muffler 232 and flowing along a surface thereof and to prevent refrigerant gas 210 passing through suction muffler 232 from being heated. Therefore, it is possible to more significantly improve the volumetric efficiency.

In addition, oil fence 662 is formed by using a flexible resin film made of PET or the like and oil is interposed between distal end portion 672 of oil fence 662 and upper inner surface 268 of closed container 202 at the time of a low-speed operation in which the vibration during the operation is intense. Accordingly, it is possible to prevent wear or damage even when distal end portion 672 and upper inner surface 268 of closed container 202 vibrate in accordance with the vibration of compression unit 206, and thus a gap between upper inner surface 268 of closed container 202 and upper surface 256 of cylinder 222 can be narrowed. Accordingly, it is possible to decrease the overall height of the closed compressor.

Note that, in the sixth embodiment, oil fence 662 is formed by using a flexible resin film made of PET or the like. However, it is possible to obtain the same effect even when oil fence 662 is formed by using flexible rubber or resin.

Seventh Embodiment

Figure 11:
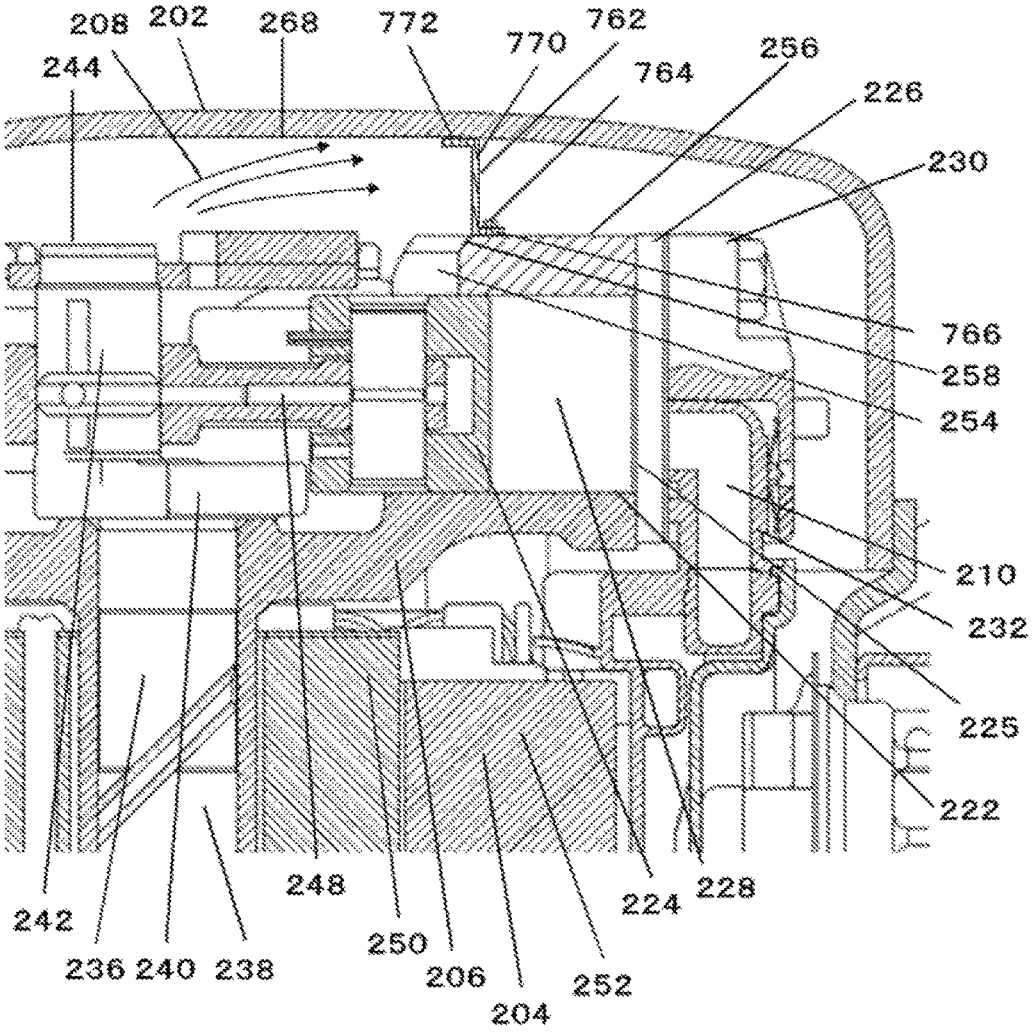
FIG. 11 is a sectional view illustrating a main portion of a closed compressor according to a seventh embodiment of the invention.

FIG. 11 is a sectional view illustrating a main portion of a closed compressor according to a seventh embodiment of the invention.

In FIG. 11, constituent elements (components) of the closed compressor according to the seventh embodiment which are the same as those of the closed compressor according to the second embodiment are given the same reference numbers and description thereof will be omitted.

Oil fence 762 which is formed by using a flexible resin film made of polyethylene terephthalate (PET) or the like is provided in the vicinity of slot 254 that is present on upper surface 256 of cylinder 222 on shaft 236 side.

Oil fence 762 is formed to include fixed portion 766 as one end and free end 770 as the other end.

Oil fence 762 includes fixed portion 766 which is fastened to the vicinity of slot 254 on upper surface 256 of cylinder 222 with fixing bolt 764 and oil fence 762 is bent to extend in a direction perpendicular to fixed portion 766 or in a vertical direction. In addition, oil fence 762 includes free end 770, which has a flat surface of which the longitudinal section is straight line-shaped and extends toward upper inner surface 268 of closed container 202, and a flat surface which is bent to extend in a direction orthogonal to free end 770 or in a horizontal direction and of which the longitudinal section is straight line-shaped. Furthermore, oil fence 762 is formed to include distal end portion 772 as a distal end of free end 770 which comes into contact with upper inner surface 268 of closed container 202.

In a longitudinal section, an angle between fixed portion 766 and free end 770 faces an obtuse angle between upper surface 256 of cylinder 222 and chamfer 258. The vertex of the angle between fixed portion 766 and free end 770 coincides with the vertex of the obtuse angle between upper surface 256 of cylinder 222 and chamfer 258 at one point.

Although the description made here indicates that the vertex of the angle between fixed portion 766 and free end 770 meets the vertex of the obtuse angle between upper surface 256 of cylinder 222 and chamfer 258 at one point, the vertex of the angle between fixed portion 766 and free end 770 may meet the vertex of the obtuse angle between upper surface 256 of cylinder 222 and chamfer 258 at two points with fixed portion 766 being disposed above slot 254.

Regarding the closed compressor configured as described above, an operation and an effect of flexible oil fence 762 will be described.

When shaft 236 rotates, oil 208 that is pumped up from a lower end of shaft 236 passes through oil supply passage 246 and is scattered from upper end portion 244 of eccentric shaft portion 242 toward oil fence 762 as illustrated by arrows in FIG. 11 due to a centrifugal force. Scattered oil 208 is held back by free end 770 of oil fence 762 and thus it is possible to prevent hot oil 208 from being sprinkled onto suction muffler 232 and flowing along a surface thereof. Therefore, refrigerant gas 210 passing through suction muffler 232 is prevented from being heated and thus it is possible to improve the volumetric efficiency of the closed compressor.

An angle between upper inner surface 268 of closed container 202 on eccentric shaft portion 242 side and free end 770 of oil fence 762 is an approximately right angle.

When compression unit 206 vibrates upward due to the vibration of compression unit 206 which occurs when the closed compressor is activated or stopped, free end 770 of oil fence 762 is bent.

Here, oil fence 762 is formed by using a flexible resin film made of polyethylene terephthalate (PET) or the like. Since oil 208 is interposed between distal end portion 772 of free end 770 of oil fence 762 which is in contact with upper inner surface 268 of closed container 202 and upper inner surface 268 of closed container 202, it is possible to suppress wear even in a case where distal end portion 772 slides on upper inner surface 268 of closed container 202 due to the vibration of compression unit 206 which occurs when the closed compressor is activated or stopped. In addition, since it is possible to prevent oil fence 762 from being damaged, a gap between upper inner surface 268 of closed container 202 and upper surface 256 of cylinder 222 can be narrowed. Accordingly, it is possible to decrease the overall height of the closed compressor.

Next, an operation and an effect of fixed portion 766 of oil fence 762 being fixed to the vicinity of slot 254 that is present on upper surface 256 of cylinder 222 on shaft 236 side will be described.

A portion of oil 208 which adheres to upper inner surface 268 of closed container 202 is held back by distal end portion 772 of oil fence 762 and a portion of oil 208 which flies to free end 770 is held back by free end 770, the entire portion of oil 208 being scattered from upper end portion 244 of eccentric shaft portion 242 toward oil fence 762 as illustrated by the arrows in FIG. 11 due to the centrifugal force. Then, oil 208 which is held back flows down to chamfer 258 of slot 254 along a surface of free end 770 on shaft 236 side and is supplied to piston 224 along a side surface of slot 254 from chamfer 258. Accordingly, it is possible to increase the amount of oil supplied to piston 224, to improve lubrication of piston 224, and to improve the reliability.

Note that, slot 254 is provided with chamfer 258 and is formed into an earthenware mortar-like shape so that slot 254 is positioned at a lower position than upper surface 256 of cylinder 222. Accordingly, oil 208 flowing down to upper surface 256 of cylinder 222 can be caused to flow toward slot 254 side efficiently and it is possible to further improve the reliability of piston 224 with an increase in the amount of oil 208 supplied to piston 224.

Next, an operation and an effect of flexible oil fence 762 which is provided on upper surface 256 of cylinder 222 on shaft 236 side pertaining to a case of an inverter-driving operation at a plurality of operation frequencies will be described.

At the time of a high-speed operation, the centrifugal force is increased. Therefore, oil 208 is scattered from upper end portion 244 of eccentric shaft portion 242 toward upper inner surface 268 of closed container 202 as illustrated by the arrows in FIG. 11. However, oil 208 which is scattered in an upper space of closed container 202 and adheres to upper inner surface 268 of closed container 202 is effectively held back by distal end portion 772 since distal end portion 772 of oil fence 762 is in contact with upper inner surface 268 of closed container 202. Accordingly, it is possible to prevent hot oil 208 from being sprinkled onto suction muffler 232 and flowing along a surface thereof and to prevent refrigerant gas 210 passing through suction muffler 232 from being heated. Therefore, it is possible to more significantly improve the volumetric efficiency.

In addition, oil fence 762 is formed by using a flexible resin film made of PET or the like and oil is interposed between distal end portion 772 of oil fence 762 and upper inner surface 268 of closed container 202 at the time of a low-speed operation in which the vibration during the operation is intense. Accordingly, it is possible to prevent wear or damage even when distal end portion 772 and upper inner surface 268 of closed container 202 vibrate in accordance with the vibration of compression unit 206, and thus a gap between upper inner surface 268 of closed container 202 and upper surface 256 of cylinder 222 can be narrowed. Accordingly, it is possible to decrease the overall height of the closed compressor.

Note that, in the sixth embodiment, oil fence 762 is formed by using a flexible resin film made of PET or the like. However, it is possible to obtain the same effect even when oil fence 762 is formed by using flexible rubber or resin.

(Refrigeration Device)

Figure 12:
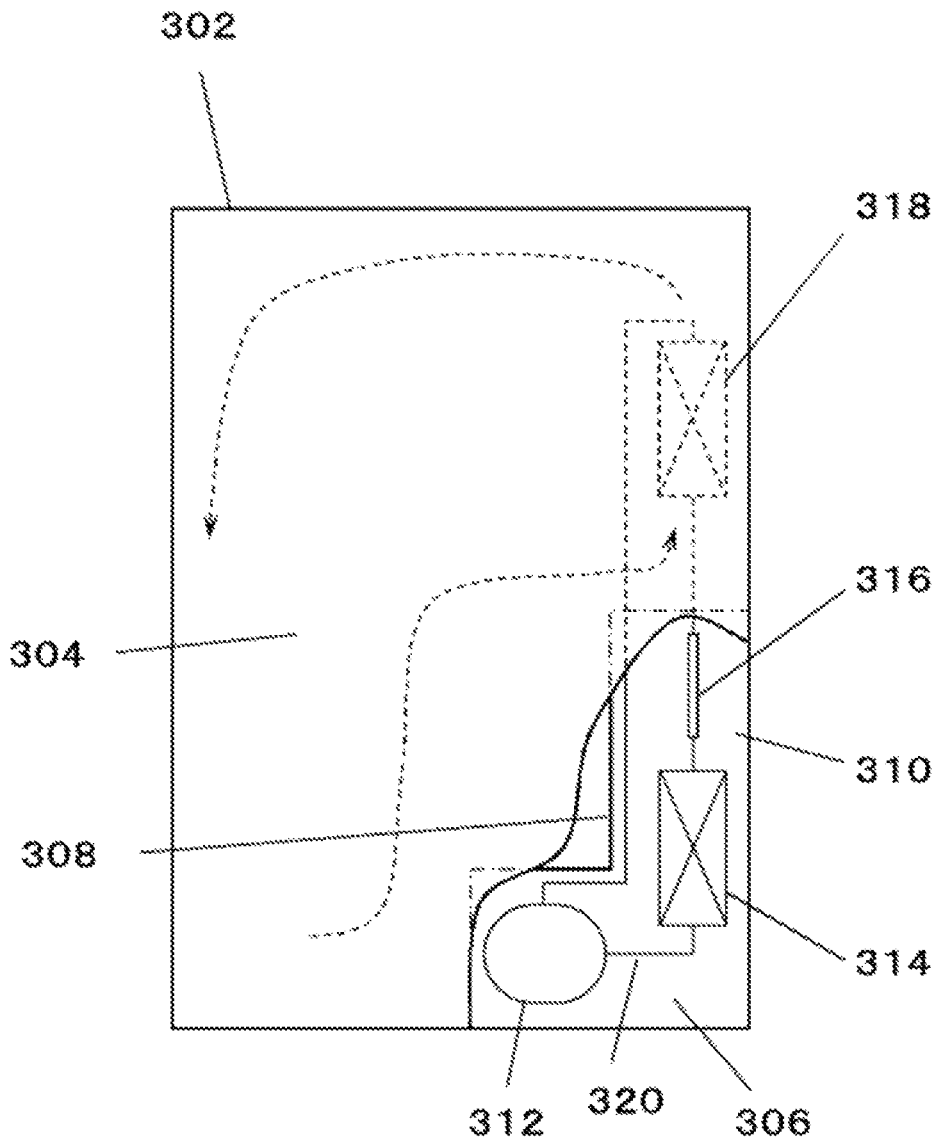
FIG. 12 is a schematic view of a refrigeration device using the closed compressor according to any one of the first to seventh embodiments of the invention.
Figure 13:
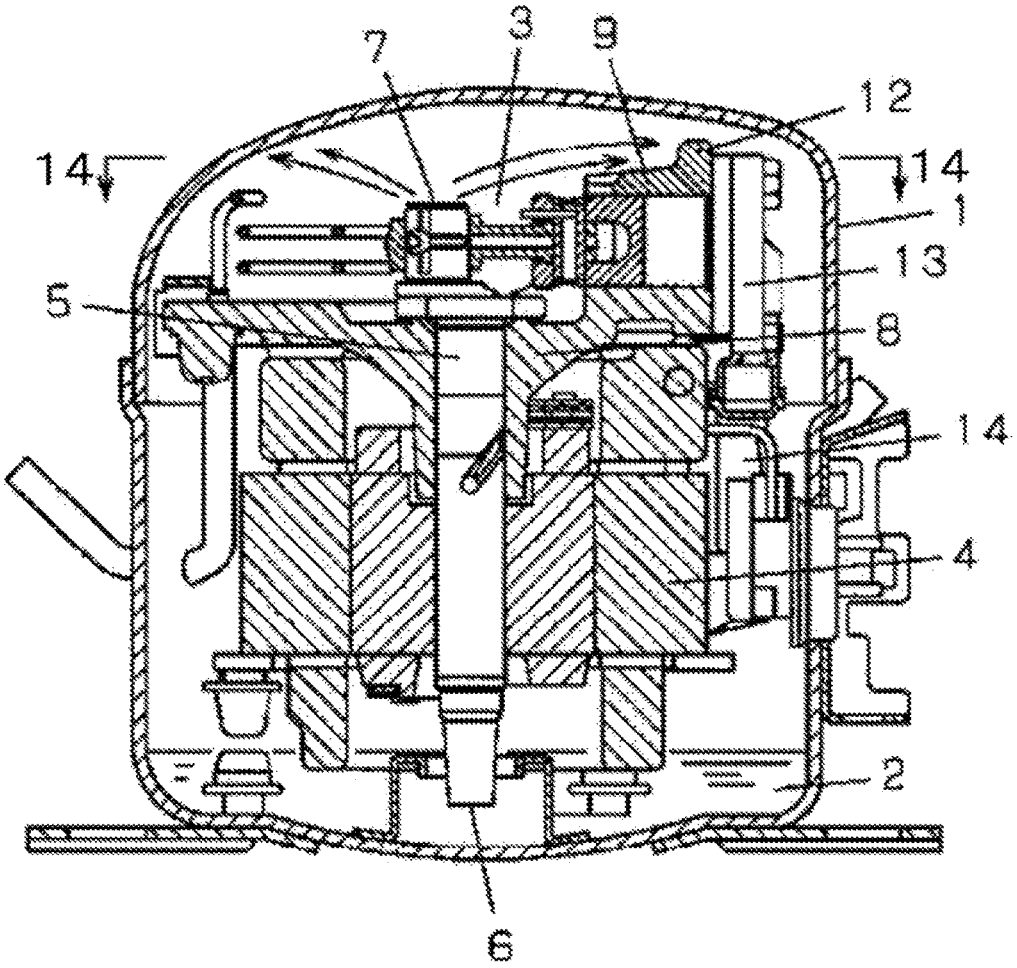
FIG. 13 is a side sectional view of a closed electric compressor in the related art.
Figure 14:
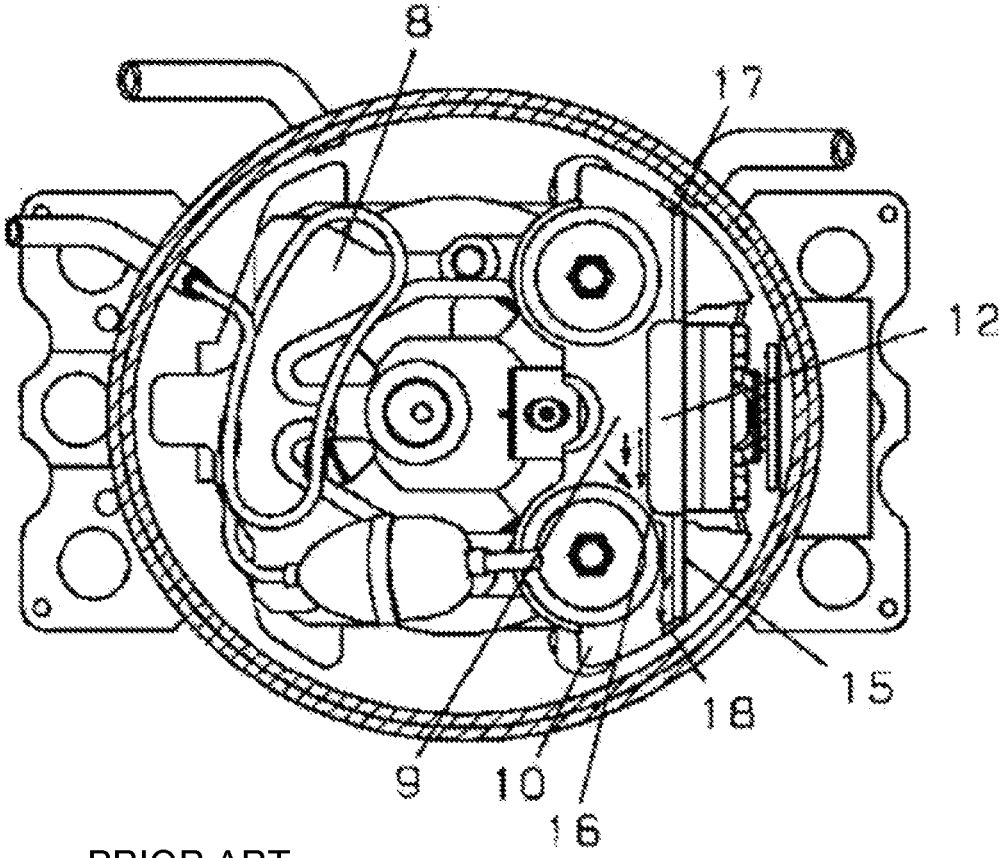
FIG. 14 is a sectional view taken along arrow 14-14 in FIG. 13.

FIG. 12 is a schematic view illustrating a configuration of a refrigeration device using the closed compressor according to any one of the first to seventh embodiments of the invention. Here, the outline of a basic configuration of the refrigeration device will be described on the assumption that the refrigeration device is configured by mounting the closed compressor described in any one of the first to seventh embodiments in a refrigerant circuit.

In FIG. 12, the refrigeration device includes main body 302, which is constituted by a heat insulating casing that includes an opening provided on one surface thereof and a door body that opens or closes the opening, partition wall 308 which partitions the inner space of main body 302 into storage space 304 for items and machine room 306, and refrigerant circuit 310 which cools storage space 304.

Refrigerant circuit 310 has a configuration in which the closed compressor described in any one of the first to seventh embodiments as compressor 312, radiator 314, decompression device 316, and heat absorbing device 318 are connected into an annular shape via pipe 320. In addition, heat absorbing device 318 is disposed in storage space 304 provided with an air blower (not shown). The air blower stirs hot air cooled by heat absorbing device 318 so that the hot air circulate in storage space 304 as illustrated by arrows in FIG. 12 and storage 304 is cooled.

The closed compressor according to any one of the first, third, and fifth embodiments of the invention as compressor 312 is mounted in the refrigeration device as described above. Accordingly, in compressor 312, free end 170, 370, or 570 of flexible oil fence 162, 362, or 562 which is provided on upper surface 156 of cylinder 122 extends toward upper inner surface 168 of closed container 102 and distal end portion 172, 372, or 572 of free end 170, 370, or 570 is close to upper inner surface 168 of closed container 102. According to this configuration, oil 108 which is scattered from upper end portion 144 of eccentric shaft portion 142 toward oil fence 162, 362, or 562 due to the centrifugal force is more efficiently held back by free end 170, 370, or 570 of oil fence 162, 362, or 562. Accordingly, it is possible to prevent hot oil 108 from being sprinkled onto suction muffler 132 and flowing along a surface thereof and to prevent refrigerant gas 110 passing through suction muffler 132 from being heated. Therefore, it is possible to more significantly improve the volumetric efficiency of the closed compressor and thus it is possible to achieve lower power consumption in the refrigeration device.

In addition, oil fence 162, 362, or 562 is formed by using a flexible resin film made of PET or the like. According to this configuration, even when distal end portion 172, 372, or 572 of oil fence 162, 362, or 562 collides with upper inner surface 168 of closed container 102 due to the vibration of compression unit 106, oil fence 162, 362, or 562 can be prevented from being damaged and thus a gap between upper inner surface 168 of closed container 102 and upper surface 156 of cylinder 122 can be narrowed. Therefore, it is possible to decrease the overall height of the closed compressor and thus it is possible to decrease the height of machine room 306 of the refrigeration device and to increase the volume of storage space 304.

In addition, the closed compressor according to any one of the second, fourth, sixth, and seventh embodiments of the invention is mounted as compressor 312 so that compressor 312 is provided with flexible oil fence 262, 462, 662, or 762 in upper surface 256 of cylinder 222. Furthermore, free end 270, 470, 670, or 770 of oil fence 262, 462, 662, or 762 extends toward upper inner surface 268 of closed container 202 and distal end portion 272, 472, 672, or 772 of free end 270, 470, 670, or 770 of oil fence 262, 462, 662, or 762 is in contact with upper inner surface 268 of closed container 202. Therefore, oil 208 which is scattered in the upper space of closed container 202 and oil 208 which adheres to upper inner surface 268 of closed container 202 are more efficiently held back by free end 270, 470, 670, or 770 and distal end portion 272, 472, 672, or 772 of oil fence 262, 462, 662, or 762. In addition, it is possible to prevent hot oil 208 from being sprinkled onto suction muffler 232 and flowing along a surface thereof and to prevent refrigerant gas 210 passing through suction muffler 232 from being heated. Therefore, it is possible to more significantly improve the volumetric efficiency of the closed compressor and thus it is possible to achieve lower power consumption in the refrigeration device.

In addition, oil fence 262, 462, 662, or 762 is formed by using a flexible resin film made of PET or the like and oil 208 is interposed between distal end portion 272, 472, 672, or 772 of oil fence 262, 462, 662, or 762 and upper inner surface 268 of closed container 202. Accordingly, it is possible to prevent wear or damage even when distal end portion 272, 472, 672, or 772 and upper inner surface 268 of closed container 202 vibrate in accordance with the vibration of compression unit 206, and thus a gap between upper inner surface 268 of closed container 202 and upper surface 256 of cylinder 222 can be narrowed. In addition, it is possible to decrease the overall height of the closed compressor and thus it is possible to decrease the height of machine room 306 of the refrigeration device and to increase the volume of storage space 304.

As described above, a closed compressor of the invention includes a closed container that reserves oil and accommodates an electric unit and a compression unit driven by the electric unit, in which the compression unit includes a shaft that is constituted by a main shaft portion and an eccentric shaft portion and includes an oil supply passage in which a lower end of the main shaft portion is immersed in the oil and an upper end portion of the eccentric shaft portion opens into the closed container. In addition, the compression unit includes a cylinder that is disposed being separated from the shaft in a lateral direction, a cylinder head that is disposed being further separated from the shaft in the lateral direction and is disposed beside the cylinder, and a suction muffler that is disposed below the cylinder head and through which a refrigerant gas passes. Furthermore, a flexible oil fence, of which a fixed portion as one end is fixed onto an upper surface of the cylinder between the shaft and the cylinder head and a free end as the other end extends toward an upper inner surface of the closed container, is provided.

According to this configuration, a collision sound can be prevented from being generated or the oil fence can be prevented from being damaged even in a case where the free end of the oil fence that extends toward the upper inner surface of the closed container collides with the upper inner surface of the closed container due to the vibration of the compression unit which occurs when the closed compressor is activated or stopped. Therefore, it is possible to narrow a gap between the upper inner surface of the closed container and the upper surface of the cylinder and thus it is possible to decrease the overall height of the closed compressor. Furthermore, it is possible to prevent hot oil from flowing along a surface of a suction muffler with the oil fence holding back oil, which is scattered from an upper end portion of the eccentric shaft due to a centrifugal force. In addition, it is possible to prevent a refrigerant gas passing through the suction muffler from being heated and thus it is possible to improve the volumetric efficiency of the closed compressor.

In addition, a closed compressor of the invention includes a closed container that reserves oil and accommodates an electric unit and a compression unit driven by the electric unit, in which the compression unit includes a shaft that is constituted by a main shaft portion and an eccentric shaft portion and includes an oil supply passage in which a lower end of the main shaft portion is immersed in the oil and an upper end portion of the eccentric shaft portion opens into the closed container. In addition, the compression unit includes a cylinder that is disposed being separated from the shaft in a lateral direction and includes a slot that is formed on an upper side surface on the shaft side, a cylinder head that is disposed being further separated from the shaft in the lateral direction and is disposed beside the cylinder, and a piston that is disposed below the slot and reciprocates in the cylinder. Furthermore, a flexible oil fence, of which a fixed portion as one end is fixed onto an upper surface of the cylinder between the shaft and the cylinder head and a free end as the other end extends toward an upper inner surface of the closed container, is provided.

According to this configuration, a collision sound can be prevented from being generated or the oil fence can be prevented from being damaged even in a case where the free end of the oil fence that extends toward the upper inner surface of the closed container collides with the upper inner surface of the closed container due to the vibration of the compression unit which occurs when the closed compressor is activated or stopped. Therefore, it is possible to narrow a gap between the upper inner surface of the closed container and the upper surface of the cylinder and thus it is possible to decrease the overall height of the closed compressor. In addition, since oil which is scattered from the upper end portion of the eccentric shaft portion toward the oil fence due to the centrifugal force is held back by the oil fence, the oil is supplied to the piston along the slot. Accordingly, it is possible to increase the amount of oil supplied to the piston, to improve lubrication of the piston, and to improve the reliability of the closed compressor.

In addition, in the invention, the free end of the oil fence may be close to the upper inner surface of the closed container.

According to this configuration, almost the entire portion of the oil which is scattered from the upper end portion of the eccentric shaft portion toward the oil fence is held back by the oil fence. Accordingly, it is possible to prevent hot oil from being sprinkled onto the suction muffler and flowing along a surface of the suction muffler and to prevent the refrigerant gas passing through the suction muffler from being heated. Therefore, it is possible to more significantly improve the volumetric efficiency of the closed compressor.

In addition, in the invention, the free end of the oil fence may be in contact with the upper inner surface of the closed container.

According to this configuration, hot oil, which is a portion of the oil which adheres to the upper inner surface of the closed container and flows down toward the cylinder head side along the upper inner surface of the closed container also can be held back by the oil fence, the entire portion of the oil being scattered from the upper end portion of the eccentric shaft portion toward the oil fence due to the centrifugal force. Accordingly, it is possible to prevent the hot oil from falling in drops from the upper inner surface of the closed container to the suction muffler and to prevent the refrigerant gas passing through the suction muffler from being heated. Therefore, it is possible to more significantly improve the volumetric efficiency of the closed compressor.

In addition, in the invention, a slot may be formed on the upper side surface of the cylinder on the shaft side and the free end of the oil fence may be close to the upper inner surface of the closed container.

According to this configuration, almost the entire portion of the oil which is scattered from the upper end portion of the eccentric shaft portion toward the oil fence due to the centrifugal force is held back by the oil fence and is supplied to the piston along the slot. Accordingly, it is possible to increase the amount of oil supplied to the piston, to improve lubrication of the piston, and to improve the reliability of the closed compressor.

In addition, in the invention, a slot may be formed on the upper side surface of the cylinder on the shaft side and the free end of the oil fence may be contact with the upper inner surface of the closed container.

According to this configuration, a portion of the oil which adheres to the upper inner surface of the closed container is also held back by the oil fence and is supplied to the piston along the slot, the entire portion of the oil being scattered from the upper end portion of the eccentric shaft portion toward the oil fence due to the centrifugal force. Accordingly, it is possible to increase the amount of oil supplied to the piston, to improve lubrication of the piston, and to improve the reliability of the closed compressor.

In addition, in the invention, the fixed end of the oil fence may be fixed to a portion of the upper surface of the cylinder which is close to the shaft side.

According to this configuration, the oil which is scattered from the upper end portion of the eccentric shaft portion toward the oil fence due to the centrifugal force is held back by the oil fence and the oil flows down to the upper surface of the cylinder along a surface of the oil fence on the shaft side. Then, the oil is supplied to the piston along a side surface of the cylinder on the shaft side or the slot from the upper surface. Accordingly, it is possible to increase the amount of oil supplied to the piston, to improve lubrication of the piston, and to improve the reliability.

In addition, in the invention, the compression unit may be inverter-driven at a plurality of operation frequencies by the electric unit.

According to this configuration, although the amount of oil being scattered from the upper end portion of the eccentric shaft portion toward the upper inner surface of the closed container is increased due to an increase in the centrifugal force at the time of high-speed rotation, the oil which is scattered is held back by the oil fence since the free end of the oil fence extends toward the upper inner surface of the closed container.

In addition, in the invention, a refrigeration device may include a refrigerant circuit in which a compressor, a radiator, a decompression device and a heat absorbing device are connected into an annular shape via a pipe, in which the compressor is the closed compressor described above.

Since the closed compressor provided with the flexible oil fence of which the fixed portion is fixed to the upper surface of the cylinder and the free end extends toward the upper inner surface of the closed container is mounted and the overall height of the closed compressor can be decreased, it is possible to decrease the height of a machine room of the refrigeration device and to increase the volume of a storage space.

INDUSTRIAL APPLICABILITY

As described above, in the closed compressor according to the invention and the refrigeration device using the same, the flexible oil fence, of which the fixed portion is fixed onto the upper surface of the cylinder between the shaft and the cylinder head and the free end extends toward the upper inner surface of the closed container, is provided. Therefore, it is possible to decrease the overall height of the closed compressor and to increase the efficiency of the closed compressor. Therefore, the invention can be applied to a wide range of refrigeration devices such as a commercial showcase and a vending machine in addition to refrigeration devices for home use such as an electric refrigerator or an air conditioner.

REFERENCE MARKS IN THE DRAWINGS

102, 202 closed container
104, 204 electric unit
106, 206 compression unit
108, 208 oil
110, 210 refrigerant gas
112, 212 compressor main body
114, 214 coil spring
120, 220 cylinder block
122, 222 cylinder
124, 224 piston
125, 225 open end
126, 226 valve plate
130, 230 cylinder head
132, 232 suction muffler
134, 234 main bearing
136, 236 shaft
138, 238 main shaft portion
140, 240 flange portion
142, 242 eccentric shaft portion
144, 244 upper end portion
146, 246 oil supply passage
148, 248 connecting rod

150, 250 rotator
152, 252 stator
154, 254 slot
156, 256 upper surface
162, 262, 362, 462, 562, 662, 762 oil fence
166, 266, 366, 466, 566, 666, 766 fixed portion
168, 268 upper inner surface
170, 270, 370, 470, 570, 670, 770 free end
310 refrigerant circuit
312 compressor
314 radiator
316 decompression device
318 heat absorbing device
320 pipe

The invention claimed is:

1. A closed compressor comprising:

a closed container that reserves oil and accommodates an electric motor and a compression unit driven by the electric motor, wherein the compression unit includes a shaft that is constituted by a main shaft portion and an eccentric shaft portion and includes an oil supply passage in which a lower end of the main shaft portion is immersed in the oil and an upper end portion of the eccentric shaft portion opens into the closed container, the oil being scattered from the upper end portion of the eccentric shaft portion, a cylinder that is disposed to be separated from the shaft in a lateral direction, a cylinder head that is disposed to be further separated from the shaft in the lateral direction and is disposed beside the cylinder, and a suction muffler that is disposed below the cylinder head and through which a refrigerant gas passes, wherein an oil fence made of a flexible material, of which a fixed portion as one end is fixed onto an upper surface of the cylinder between the shaft and the cylinder head and a free end as the other end extends toward an upper inner surface of the closed container, is provided, and wherein the free end of the oil fence is configured to contact the upper inner surface of the closed container.

2. The closed compressor of claim 1, wherein the fixed portion of the oil fence is fixed to an end portion of the upper surface of the cylinder which is proximate to the shaft.

3. The closed compressor of claim 1, wherein the compression unit is inverter-driven at a plurality of operation frequencies by the electric unit.

4. A refrigeration device comprising:

a refrigerant circuit in which a compressor, a radiator, a decompressor and a heat absorber are connected into an annular shape via a pipe, wherein the compressor is the closed compressor of claim 1.

5. The closed compressor of claim 2, wherein the compression unit is inverter-driven at a plurality of operation frequencies by the electric unit.

6. A refrigeration device comprising:

a refrigerant circuit in which a compressor, a radiator, a decompressor and a heat absorber are connected into an annular shape via a pipe, wherein the compressor is the closed compressor of claim 2.

7. A refrigeration device comprising:

a refrigerant circuit in which a compressor, a radiator, a decompressor and a heat absorber are connected into an annular shape via a pipe, wherein the compressor is the closed compressor of claim 3.

8. A refrigeration device comprising:

a refrigerant circuit in which a compressor, a radiator, a decompressor decompression device and a heat absorber absorbing device are connected into an annular shape via a pipe, wherein the compressor is the closed compressor of claim 5.

9. A closed compressor comprising:

a closed container that reserves oil and accommodates an electric motor and a compression unit driven by the electric motor, wherein the compression unit includes a shaft that is constituted by a main shaft portion and an eccentric shaft portion and includes an oil supply passage in which a lower end of the main shaft portion is immersed in the oil and an upper end portion of the eccentric shaft portion opens into the closed container, the oil being scattered from the upper end portion of the eccentric shaft portion, a cylinder that is disposed to be separated from the shaft in a lateral direction and includes a slot that is formed on an upper side surface on a shaft side, a cylinder head that is disposed to be further separated from the shaft in the lateral direction and is disposed beside the cylinder, and a piston that is disposed below the slot and reciprocates in the cylinder, wherein an oil fence made of a flexible material, of which a fixed portion as one end is fixed onto an upper surface of the cylinder between the shaft and the cylinder head and a free end as the other end extends toward an upper inner surface of the closed container, is provided, and wherein the free end of the oil fence is configured to contact the upper inner surface of the closed container.

* * * * *